US007543899B2

(12) United States Patent
Konno

(10) Patent No.: US 7,543,899 B2
(45) Date of Patent: Jun. 9, 2009

(54) INKJET RECORDING APPARATUS AND LIQUID APPLICATION METHOD

(75) Inventor: Masaaki Konno, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 442 days.

(21) Appl. No.: 11/087,982

(22) Filed: Mar. 24, 2005

(65) Prior Publication Data

US 2005/0212835 A1 Sep. 29, 2005

(30) Foreign Application Priority Data

Mar. 25, 2004 (JP) ..... 2004-090260

(51) Int. Cl.
*B41J 29/38* (2006.01)
*B41J 2/01* (2006.01)

(52) U.S. Cl. ..... 347/6; 347/101

(58) Field of Classification Search ..... 347/30, 347/6, 101

See application file for complete search history.

(56) References Cited

U.S. PATENT DOCUMENTS 5,365,261 A * 11/1994 Ozawa et al. ..... 347/103
5,466,653 A * 11/1995 Ma et al. ..... 503/200
5,805,190 A 9/1998 Tsuchii et al.
6,007,182 A 12/1999 Matsubara et al.
6,050,674 A * 4/2000 Hirabayashi et al. ..... 347/40
6,264,320 B1 7/2001 Moriyama et al.
6,364,445 B1 * 4/2002 Ikeda et al. ..... 347/14
6,387,168 B1 * 5/2002 Koitabashi et al. ..... 106/31.6
6,471,347 B1 * 10/2002 Koitabashi et al. ..... 347/98
6,494,569 B2 * 12/2002 Koitabashi et al. ..... 347/98
6,540,326 B2 * 4/2003 Matsubara et al. ..... 347/41
6,582,047 B2 6/2003 Koitabashi et al.
6,637,876 B2 * 10/2003 Hori ..... 347/100
2001/0010195 A1 * 8/2001 Kessler ..... 101/483
2001/0030679 A1 * 10/2001 Kubota et al. ..... 347/102
2003/0011669 A1 * 1/2003 Tsuboi et al. ..... 347/102
2003/0218645 A1 * 11/2003 Dings et al. ..... 347/2
2004/0051862 A1 * 3/2004 Alcock et al. ..... 356/71
2004/0125164 A1 * 7/2004 Park et al. ..... 347/16

(Continued)

FOREIGN PATENT DOCUMENTS

JP 6-87222 A 3/1994

(Continued)

*Primary Examiner*—Stephen D Meier
*Assistant Examiner*—Sarah Al-Hashimi
(74) *Attorney, Agent, or Firm*—Birch, Stewart, Kolasch & Birch, LLP

(57) ABSTRACT

An inkjet recording apparatus which forms images on a recording medium by combining at least two types of liquid comprising: a first application device which applies a first liquid to the recording medium; a second application device which applies a second liquid to the recording medium in accordance with an image to be formed on the recording medium; a movement device which provides relative movement between the recording medium, the first application device and the second application device; and a control device which according to a permeation speed controls at least one of the following devices: the first application device which changes the amount of the first liquid type applied, the second application device which changes the amount of the second liquid type applied, the movement device which changes the relative movement speed of the recording medium, and a temperature variation device which varies the temperature of the recording medium.

23 Claims, 17 Drawing Sheets

U.S. PATENT DOCUMENTS

| | | | | |
|---|---|---|---|---|
| 2005/0122382 | A1* | 6/2005 | Pickering et al. | 347/104 |
| 2005/0195225 | A1* | 9/2005 | Takagi et al. | 347/7 |

FOREIGN PATENT DOCUMENTS

| | | | |
|---|---|---|---|
| JP | 8-72227 | A | 3/1996 |
| JP | 8-281931 | A | 10/1996 |
| JP | 8-281934 | A | 10/1996 |
| JP | 9-118008 | A | 5/1997 |
| JP | 9-300665 | A | 11/1997 |
| JP | 2001-105581 | A | 4/2001 |
| JP | 2001-323195 | A | 11/2001 |
| JP | 2002-210947 | A | 7/2002 |
| JP | 2002-321349 | A | 11/2002 |

* cited by examiner

INKJET RECORDING APPARATUS AND LIQUID APPLICATION METHOD

BACKGROUND OF THE INVENTION

1. Field of the Invention

The present invention relates to an inkjet recording apparatus and a liquid application method, and more particularly to an ink droplet ejection control technology which achieves a function of ensuring the insolubility or fixing properties of a coloring material, by combining two types of liquid.

2. Description of the Related Art

In recent years, inkjet printers have come to be used widely as data output apparatuses for outputting images, documents, or the like. By driving recording elements, such as nozzles, provided in a recording head in accordance with data, an inkjet printer is able to form data onto a recording medium, such as recording paper by means of ink discharged from the nozzles.

An inkjet printer forms an image on recording paper by causing a recording head having a plurality of nozzles and a recording medium to move relative to each other, while causing ink droplets to be discharged from the nozzles.

There are various types of recording medium used in inkjet recording apparatuses, and by changing the ink type and altering the ink droplet ejection control in accordance with the type of recording medium used, a desirable image is formed on the recording medium.

For example, with a permeable type of medium in which deposited ink droplets permeate into the recording medium, a dye-based ink is used, in which the ink solute is maintained in an image receiving layer inside the recording medium, and the ink deposited onto the recording medium permeates rapidly into the recording medium, thereby reducing color aberrations and tone errors caused by disruption of dot shape, or superimposition of colors.

On the other hand, in the case of a non-permeable type of medium in which the deposited ink becomes fixed on the surface of the recording medium, a pigment-based ink is used, in which the ink solute solidifies on the surface of the medium. The ink is devised in such a manner that the water content is removed swiftly from the ink droplet deposited onto the recording medium, thereby causing the ink to become fixed.

In the inkjet printer apparatus and inkjet printer method disclosed in Japanese Patent Application Publication No. 8-281931, a print enhancing solution and ink are discharged onto the same position or mutually proximate positions, and while a portion of one of the previously discharged droplets of print enhancing solution or ink remains on the surface of the print medium, the other droplet is discharged.

Moreover, in the inkjet recording apparatus and inkjet recording method described in Japanese Patent Application Publication No. 2002-210947, an inkjet recording apparatus performs recording in a selected recording mode. In high-speed recording mode, the amount of ink ejected per pixel is less than that in low-speed recording mode, and when recording with black ink, a dissolution inhibitor solution is discharged.

Furthermore, in the inkjet method and inkjet recording apparatus described in Japanese Patent Application Publication No. 2002-321349, a recording head which discharges ink and a recording head which discharges treatment liquid for creating a prescribed action with respect to the coloring material of the ink are used, the amount of treatment liquid discharged being varied in accordance with the amount and type of the ink coloring material.

However, when various types of recording media are used, then the speed of permeation of the liquid droplets varies significantly, depending on the combination of recording medium and ink used. Therefore, it is necessary to control the amounts of treatment liquid and ink applied, in accordance with the combination of recording medium and ink. For example, the amount of liquid remaining on the recording medium after a prescribed time period will be different between the case of normal paper having rapid permeation properties and the case of coated printing paper having slow permeation properties. Therefore, unless suitable measures are taken with regard to the ejection droplet amount or processing of the remaining water content, in accordance with the type of recording medium, it will be difficult to form satisfactory images.

In the inkjet printer apparatus and inkjet printing method described in Japanese Patent Application Publication No. 8-281931, there is no disclosure regarding technology stating how to judge the time period during which liquid actually remains on the print medium, when the type of print medium is changed. Furthermore, in order to that both ink and a print enhancing solution can be discharged from the inkjet head, it is necessary for the print enhancing solution to have liquid properties (namely, viscosity, surface tension, etc.) which allow it to be discharged from the inkjet head.

Moreover, the inkjet recording apparatus and the inkjet recording method described in Japanese Patent Application Publication No. 2002-210947 disclose technology for controlling the amount of the ejected ink droplets in accordance with the selected recording mode, but there is no disclosure regarding technology for controlling the amount of the ejected droplets in accordance with the type of recording medium.

Furthermore, the inkjet method and the inkjet recording apparatus described in Japanese Patent Application Publication No. 2002-321349 disclose technology for controlling the amount of treatment liquid droplets in accordance with the amount and type of the ink coloring material, but there is no disclosure regarding technology for controlling the amount of the ejected droplets in accordance with the type of recording medium.

SUMMARY OF THE INVENTION

The present invention has been contrived in view of such circumstances, and an object thereof is to provide an inkjet recording apparatus and a liquid application method, whereby satisfactory images can be formed onto recording media of various types, by controlling liquid application in accordance with the permeation speed of the ink.

In order to attain the aforementioned object, the present invention is directed to an inkjet recording apparatus which forms images on a recording medium by combining at least two types of liquid, the apparatus comprising: a first application device which applies a first liquid to the recording medium; a second application device which applies a second liquid to the recording medium in accordance with an image to be formed on the recording medium; a movement device which moves the first application device and the second application device relatively with respect to the recording medium; and a control device which performs at least one type of control, from among first liquid application amount change control which changes an applied amount of the first liquid, second liquid application amount change control which changes an applied amount of the second liquid, relative movement speed control of the recording medium by means of the movement device, and temperature variation control of the recording medium, in accordance with a permeation speed of at least one of the first liquid and the second liquid with respect to the recording medium.

According to the present invention, the first liquid application amount control, second liquid application amount control, recording medium conveyance speed control and recording medium temperature control are implemented in accordance with the permeation speed information relating to at least one of the permeation speed of the first liquid and the permeation speed of the second liquid. Therefore, the first liquid and the second liquid combine reliably and the combined reaction of the first liquid and the second liquid proceeds reliably.

In order to control the temperature of the recording medium, a temperature variation device, such as a heater or cooler which alters the temperature of the recording medium, is provided.

The recording medium may be a paper medium, such as continuous paper, cut paper or sealed paper, a resin sheet, such as an OHP sheet, film, cloth, metal, or various other media, regardless of the material. Furthermore, the recording medium includes media known as discharge receiving medium media, liquid receiving media, image forming media, and the like.

Preferably, the inkjet recording apparatus further comprises: a storage device which previously stores the permeation speed of at least one of the first liquid and the second liquid with respect to the recording medium, wherein the control device performs at least one type of control, from among the first liquid application amount change control which changes the applied amount of the first liquid, the second liquid application amount change control which changes the applied amount of the second liquid, the relative movement speed control of the recording medium by means of the movement device, and the temperature variation control of the recording medium, in accordance with information on the permeation speed of the at least one of the first liquid and the second liquid stored in the storage device. According to this, if the permeation speeds of the first liquid and the second liquid are previously recorded in a recording device, then the permeation speeds of the first liquid and the second liquid do not need to be measured.

Alternatively, it is also preferable that the inkjet recording apparatus further comprises: a measurement device which measures the permeation speed of at least one of the first liquid and the second liquid with respect to the recording medium, wherein the control device performs at least one type of control, from among the first liquid application amount change control which changes the applied amount of the first liquid, the second liquid application amount change control which changes the applied amount of the second liquid, the relative movement speed control of the recording medium by means of the movement device, and the temperature variation control of the recording medium, in accordance with the permeation speed of the at least one of the first liquid and the second liquid with respect to the recording medium measured by the measuring device. According to this, if a composition is adopted in which the permeation speeds of the first liquid and the second liquid are measured, then the actual permeation speed of the first liquid and the second liquid can be measured in real time, and hence there is no restriction on compatibility with the first liquid and the second liquid.

Desirably, the permeation speed measurement device is provided in a stage prior to the first application device and the second application device.

Preferably, the measurement device comprises a glossy reflection intensity measurement device which measures glossy reflection intensity of a droplet of the liquid on a surface of the recording medium. The mode of the glossy reflection intensity measurement device may comprise a light source which irradiates light onto the liquid droplets on the recording medium, and a determination device which determines the light reflected by the liquid droplets, of the light reflected by the light source.

Preferably, the control device performs application amount change control which changes the applied amount of at least one of the first liquid and the second liquid, in accordance with the permeation speed of one of the first liquid and the second liquid that has been applied to the recording medium before the other of the first liquid and the second liquid. According to this, since application amount change control is implemented in order to change the application amount of at least one of the first liquid and the second liquid, in accordance with the permeation speed of the first liquid or second liquid previously applied to the recording medium, it is possible to cause the residual amount of the liquid previously applied to the recording medium that remains on the recording medium at the time that the subsequently applied liquid is applied, to be equal to or greater than an amount at which the first liquid and the second liquid can combine. Therefore, a combined reaction of the first liquid and the second liquid can be performed reliably.

The first liquid may be applied previously or the second liquid may be applied previously.

Preferably, the first liquid includes a transparent treatment liquid which is applied to the recording medium regardless of image data of the image to be formed on the recording medium; the second liquid includes ink which is applied to the recording medium in accordance with the image data; and the inkjet recording apparatus further comprises an image processing device for processing the image data in accordance with at least one of the permeation speed of the first liquid and the applied amount of the first liquid.

According to the present invention, it is possible to cause a treatment liquid applied to the recording medium regardless of the image data, and an ink applied to the recording medium in accordance with the image data, to combine and react in a reliable fashion, and hence the insolubility characteristics and fixing properties of the coloring material contained in the ink can be improved.

Furthermore, since the amount of ink applied is increased or decreased in accordance with the increase or decrease in the amount of treatment liquid applied, it is possible, for example, to prevent tonal errors occurring due to variation in the concentration of the image formed by reaction with the second liquid, as a result of variation in the amount of treatment liquid applied. Furthermore, image processing is implemented in such a manner that the applied amounts of treatment liquid and ink are suited to the permeation speed.

Insolubility means, for example, a property of the ink coloring material which prevents it from dissolving in the ink solvent and causes it to separate after evaporation of the ink solvent, or a property whereby, when the treatment liquid and the ink react, the coloring material (solute) precipitates rather than dissolving, when it is introduced into the solvent.

On the other hand, the fixing characteristics include a state where the ink coloring material (ink solute) is retained on the surface of the recording medium or in the interior of the recording medium.

The mode for applying liquid regardless of the image may include a mode in which liquid is applied to a region where a prescribed image is to be formed, of the image formable region of the recording medium.

Preferably, the inkjet recording apparatus further comprises a liquid recovery device which recovers at least one of the first liquid and the second liquid remaining on the recording medium after the image has been formed on the recording medium. According to this, it is possible to reduce the load of the drying device which dries the recording medium after an image has been formed on the recording medium. This is particularly valuable if a non-permeable medium is used as the recording medium.

The drying device may be a liquid suction device comprising a suction member, such as a sponge, which absorbs the liquid on the recording medium, or it may be a heating device which heats the holding device (for example, the conveyance belt, conveyance roller, or other conveyance device) which holds the recording medium when it is conveyed relatively to the liquid application device and the liquid discharge device.

Preferably, the inkjet recording apparatus further comprises: a residual liquid amount prediction device which predicts an remaining amount of at least one of the first liquid and the second liquid after an image has been formed on the recording medium, wherein the liquid recovery device recovers the at least one of the first liquid and the second liquid remaining on the recording medium according to a result of prediction obtained by the residual liquid amount prediction device.

As a mode for predicting the residual amount of liquid, a database relating to parameters such as the type of recording medium, temperature, elapsed time from application (deposition) of the liquid onto the recording medium, may be created for each type of liquid, and the corresponding data may be read out from the database. Alternatively, prediction values may be calculated on the basis of the aforementioned parameters.

Preferably, the first application device includes a flexible porous member which applies the first liquid to the recording medium while making contact with the recording medium.

The mode for applying the first liquid to the recording medium may be a mode where the roller and recording medium are moved relatively to each other while rotating the roller, in such a manner that the first liquid is applied to the full surface of the first liquid application region of the recording medium, or a mode where a blade-shaped or sponge-shaped member, or the like, is used to apply liquid by making planar contact with the recording medium.

Since the first liquid is applied to the recording medium by means of a roller, or the like, it is possible to handle liquids of high viscosity, which are difficult to handle in a discharge head that discharges liquid droplets from discharge holes.

Preferably, the first liquid has higher viscosity than the second liquid. More specifically, since the permeation speed of the first liquid can be slowed by increasing the viscosity of the first liquid, then it is possible to ensure that the second liquid is deposited on the recording medium before the first liquid has permeated completely into the recording medium.

The first liquid may be set to a high viscosity by lowering the temperature of the recording medium, by means of a temperature variation device, or the like.

Preferably, the second application device includes a discharge head which discharges the second liquid onto the recording medium.

The discharge head may be a full line type discharge head in which discharge holes for discharging liquid droplets are arranged through a length corresponding to the entire width of the discharge receiving medium, or a serial type discharge head (shuttle scanning type discharge head) in which a short head having discharge holes for discharging liquid droplets arranged through a length that is shorter than the entire width of the discharge receiving medium discharges liquid droplets onto the discharge receiving medium while scanning in the breadthways direction of the discharge receiving medium. The discharge head may include a print head which discharges ink onto a recording medium in an inkjet recording apparatus. The "discharge receiving medium" referred to here is a liquid receiving medium which receives liquid discharged from a discharge head. The "discharge receiving medium" may be a recording medium.

A full line discharge head may be formed to a length corresponding to the full width of the recording medium by combining short head having rows of discharge holes which do not reach a length corresponding to the full width of the discharge receiving medium, these short heads being joined together in a staggered matrix fashion.

Preferably, the first liquid includes a transparent liquid containing a cationic polymer; and the second liquid includes a colored ink containing an anionic polymer. In other words, if a transparent liquid containing a cationic polymer, namely, a polymer containing positively charged surface-active ions, is applied to the recording medium as the first liquid, and if a colored ink containing an anionic polymer, namely, a polymer containing negatively charged surface-active ions, is applied as the second liquid, then the insolubility of the ink and the fixing properties of the ink can be ensured by reaction between the first liquid and the second liquid.

In order to attain the aforementioned object, the present invention is also directed to a liquid application method for an inkjet recording apparatus which forms images on a recording medium by combining at least two types of liquid, the method comprising: a first application step of applying a first liquid to the recording medium by a first application device; a second application step of applying a second liquid to the recording medium by a second application device in accordance with an image to be formed on the recording medium; a movement step of moving the first application device and the second application device relatively with respect to the recording medium by a movement device; and a control step of performing at least one type of control, from among first liquid application amount change control which changes an applied amount of the first liquid, second liquid application amount change control which changes an applied amount of the second liquid, relative movement speed control of the recording medium by means of the movement device, and temperature variation control of the recording medium, in accordance with a permeation speed of at least one of the first liquid and the second liquid with respect to the recording medium.

According to the present invention, at least one type of control, from among first liquid application amount change control, second liquid application amount change control, recording medium relative movement speed control, and recording medium temperature variation control, is implemented in accordance with the permeation speed of at least one of a first liquid applied to the recording medium and a second liquid applied to the recording medium in accordance with the image to be formed thereon. Therefore, the first liquid and the second liquid are made to combine reliably, and the combined reaction of the first liquid and the second liquid is performed reliably.

If a transparent treatment liquid is used as the first liquid and a colored ink containing a coloring material is used as the second liquid, then the treatment liquid and the ink are made to combine reliably, the combined reaction between the treatment liquid and the ink is performed reliably, and hence the insolubility and fixing properties of the coloring material can be ensured.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
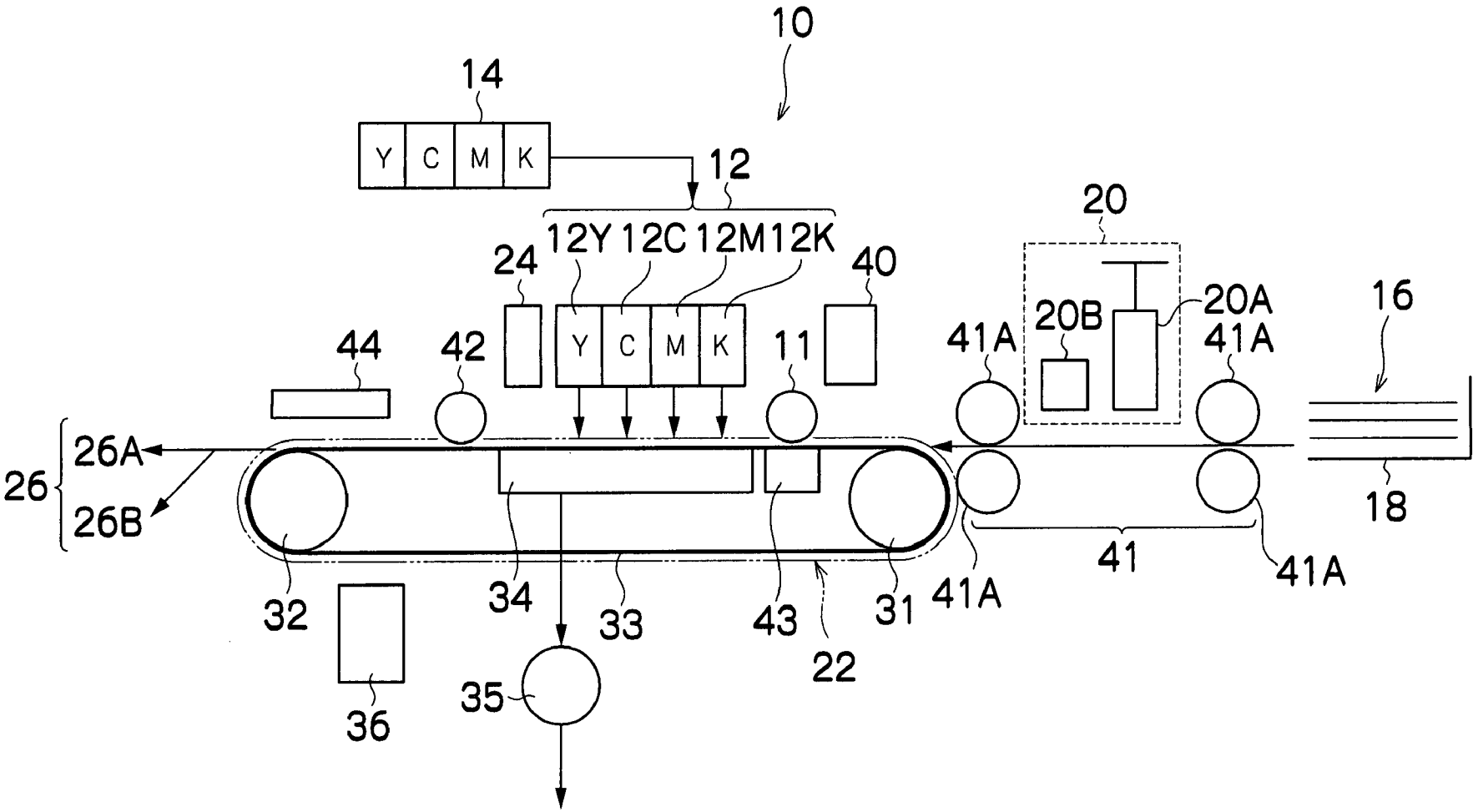
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, this inkjet recording apparatus 10 is constituted in such a manner that it forms images by means of an ink containing a coloring material having an insolubility function (a property whereby the coloring material forming the solute does not dissolve into the solvent) and a fixing function, by combining two types of liquid.

The inkjet recording apparatus 10 comprises: a treatment liquid applying unit 11 (the details of which are described hereafter) having a roller (indicated by reference 11A in FIGS. 10A and 10B) including a flexible porous member which applies a treatment liquid (first liquid, liquid A) that is transparent and is applied regardless of the image formed; a printing unit 12 having a plurality of print heads 12K, 12M, 12C, and 12Y provided respectively for the ink colors of black (K), magenta (M), cyan (C), and yellow (Y), each print head discharging a colored ink including a second liquid (liquid B); an ink storing and loading unit 14 for storing inks of K, M, C and Y to be supplied to the print heads 12K, 12M, 12C, and 12Y; a paper supply unit 18 for supplying recording paper 16; a permeation speed measurement unit 20 for measuring the permeation speed of the treatment liquid applied to the surface of the recording paper 16 by the treatment liquid applying unit 11; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper. Also, in the case of configuration in which roll paper is used, a decurling unit 20 for removing curl in the recording paper 16 is provided to upstream of the treatment liquid applying unit 11.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

In the case of the configuration in which roll paper is used, a cutter (first cutter) is provided, and the continuous paper is cut into a desired size by the cutter. The cutter has a stationary blade, whose length is not less than the width of the conveyor pathway of the recording paper 16, and a round blade, which moves along the stationary blade. The stationary blade is disposed on the reverse side of the printed surface of the recording paper 16, and the round blade is disposed on the printed surface side across the conveyor pathway. When cut paper is used, the cutter is not required.

In the present embodiment, recording paper (cut paper) 16 is used as the recording medium onto which images are formed, but the scope of application of the present invention is not limited to paper media, and various other types of media may be used. Examples of recording media include resin sheet, film, metal, cloth, wood, and the like.

The recording paper 16 supplied by the paper supply unit 18 is conveyed to the suction belt conveyance unit 22 by passing by the permeation speed measurement unit 20. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the counterclockwise direction in FIG. 1 by the motive force of a motor 88 (not shown in FIG. 1, but shown in FIG. 7) being transmitted to at least one of the rollers 31 and 32, which the belt 33 is set around, and the recording paper 16 held on the belt 33 is conveyed from right to left in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the treatment liquid applying unit 11 in the conveyance pathway formed by the suction belt conveyance unit 22. The heating fan 40 blows heated air onto the recording paper 16 to heat the recording paper 16 immediately before printing so that the ink deposited on the recording paper 16 dries more easily. Furthermore, the inkjet recording apparatus 10 also comprises a cooler 43 which cools the recording paper 16 (namely, the treatment liquid applied to the recording paper 16 by the treatment liquid applying unit 11). The cooler 43 is provided at a position on the belt 33 which corresponds to the treatment liquid applying unit 11. The cooler 43 may be constituted by a tubular member filled with cooling water, a refrigerant, or the like, or by a cooling fan which blows a cool air flow onto the recording paper 16. More specifically, it is possible to adopt various other compositions for the cooler 43 apart from those described above, provided that the temperature of the recording paper 16 can be lowered by the cooler 43. Furthermore, although not illustrated in FIG. 1, a temperature detector for determining the temperature of the recording paper 16 is provided. The heating fan 40 or cooler 43 is controlled on the basis of the temperature information determined by the temperature detector. The control of the heating fan 40 and cooler 43 is described in detail below.

Figure 2:
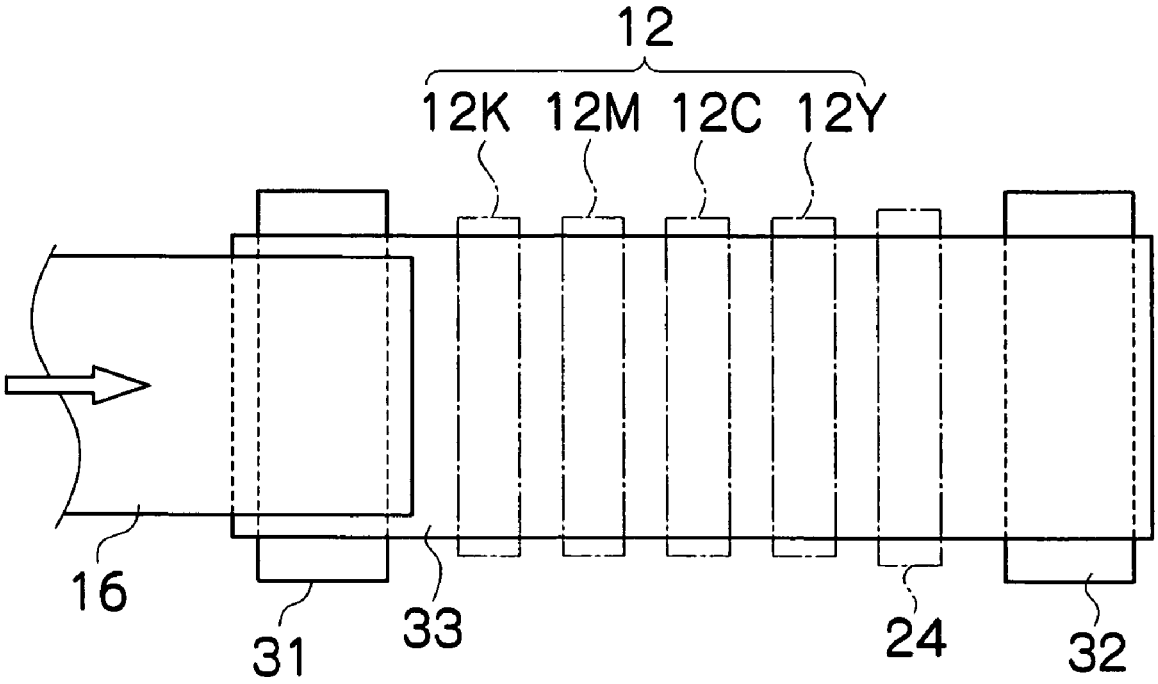
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. A specific structural example is described later with reference to FIGS. 3A to 5. Each of the print heads 12K, 12M, 12C, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12K, 12M, 12C, and 12Y are arranged in this order from the upstream side along the paper conveyance direction. A color print can be formed on the recording paper 16 by ejecting the inks from the print heads 12K, 12M, 12C, and 12Y, respectively, onto the recording paper 16 while conveying the recording paper 16.

The printing unit 12, in which the full-line heads covering the entire width of the paper are thus provided for the respective ink colors, can record an image over the entire surface of the recording paper 16 by performing the action of moving the recording paper 16 and the printing unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

Although the configuration with the KMCY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

As shown in FIG. 1, the ink storing and loading unit 14 has tanks for storing the inks of K, M, C and Y to be supplied to the print heads 12K, 12M, 12C, and 12Y, and the tanks are connected to the print heads 12K, 12M, 12C, and 12Y through channels (not shown), respectively. The ink storing and loading unit 14 has a warning device (e.g., a display device, an alarm sound generator) for warning when the remaining amount of any ink is low, and has a mechanism for preventing loading errors among the colors.

The permeation speed measurement unit 20 comprises a liquid supply unit 20A, which is provided in the determination region 41 disposed on the upstream side of the treatment liquid applying unit 11 on the side corresponding to the print surface of the recording paper 16, and which supplies liquid droplets for determining the permeation speed onto the recording paper 16, and a determination unit 20B which irradiates light from a light source onto liquid droplets on the recording paper 16 and determines the light reflected by the surface of the liquid droplets. In the determination region 41, the recording paper 16 is conveyed by a roller 41A on the basis of a roller nip mechanism, in order to ensure the flatness and clearance of the recording paper 16 with respect to the determination unit 20B. Of course, it is also possible to adopt a mode in which the recording paper 16 is conveyed in the determination region 41 by being fixed onto the surface of the conveyance belt. The recording paper 16 which has been used in order to determine the permeation speed may be output and discarded directly, or it may be used to form an image. The details of the measurement of the permeation speed by the permeation speed measurement unit 20 are described below.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12M, 12C, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12M, 12C, and 12Y for the respective colors, and the ejection of each head is determined. The ejection determination includes the presence of the ejection, measurement of the dot size, and measurement of the dot deposition position.

A surplus liquid recycling unit 42 is provided after the print determination unit 24 in order to recycle the surplus liquid remaining on the recording paper 16. The details of the surplus liquid recycling unit 42 are described hereafter; a roller or sponge made of a porous member or a nonwoven cloth member is pressed against the surface of the recording paper 16, and sucks up and recycles the surplus liquid on the recording paper 16.

An after drying unit 44 is provided at a downstream stage from the surplus liquid recycling unit 42. The after drying unit 44 is a device for drying the printed image surface, and it may comprise, for example, a heating fan. It is preferable to avoid contact with the printed surface until the printed ink dries, and therefore a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

The heating/pressurizing unit (not shown) is disposed following the post-drying unit 44. The heating/pressurizing unit is a device to control the glossiness of the image surface, and the image surface is pressed with a pressure roller (not shown) having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter). The second cutter is disposed directly in front of the paper output unit 26, and is used for cutting the test print portion from the target print portion when a test print has been performed in the blank portion of the target print. The structure of the second cutter is the same as the first cutter described above, and has a stationary blade and a round blade.

Although not shown in FIG. 1, the paper output unit 26A for the target prints is provided with a sorter for collecting prints according to print orders.

Next, the structure of the print heads is described. The print heads 12K, 12M, 12C, and 12Y have the same structure, and a reference numeral 50 is hereinafter designated to any of the print heads 12K, 12M, 12C, and 12Y.

Figure 3A:
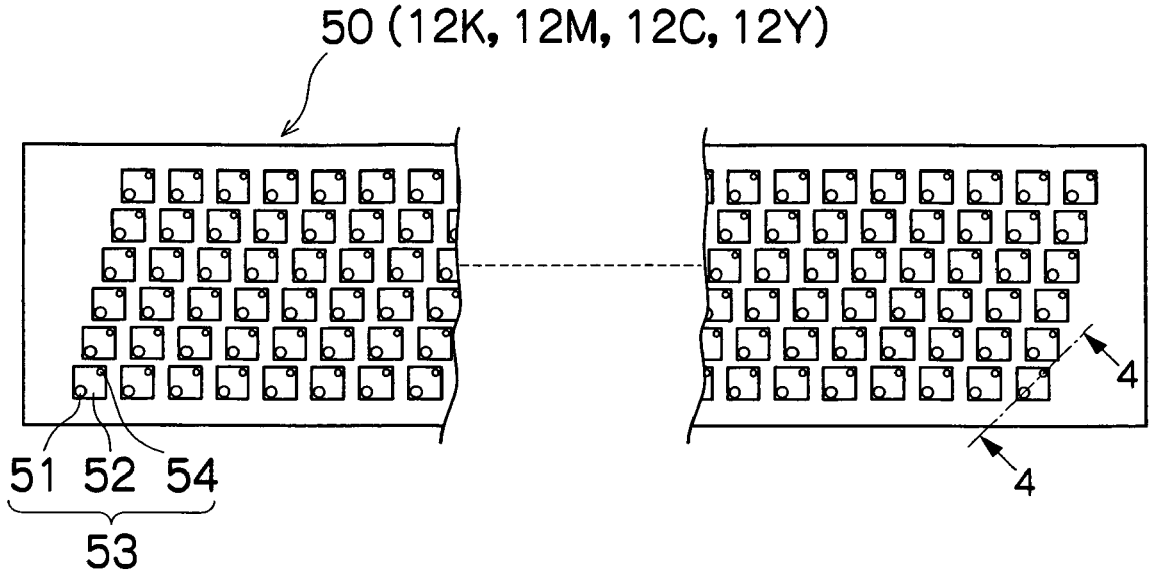
FIG. 3A is a perspective plan view showing an example of a configuration of a print head.
Figure 3B:
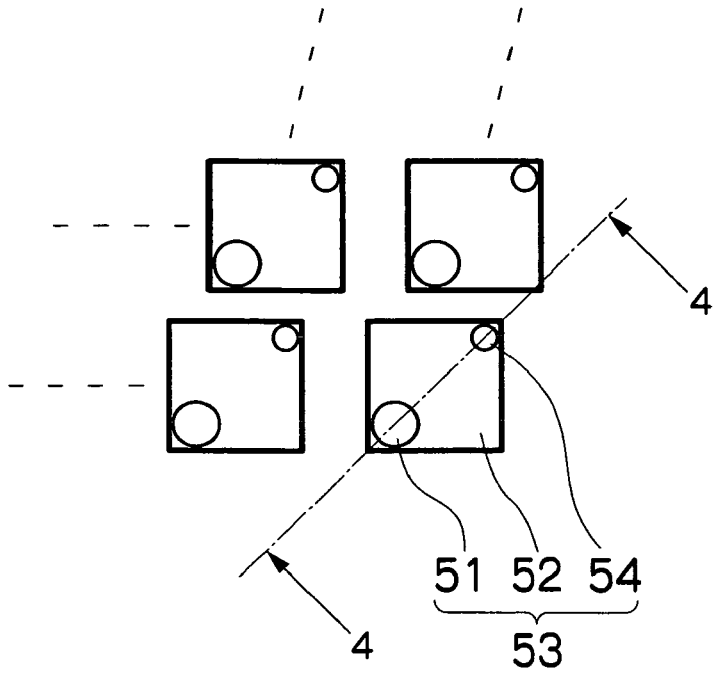
FIG. 3B is a partial enlarged view of FIG. 3A.
Figure 3C:
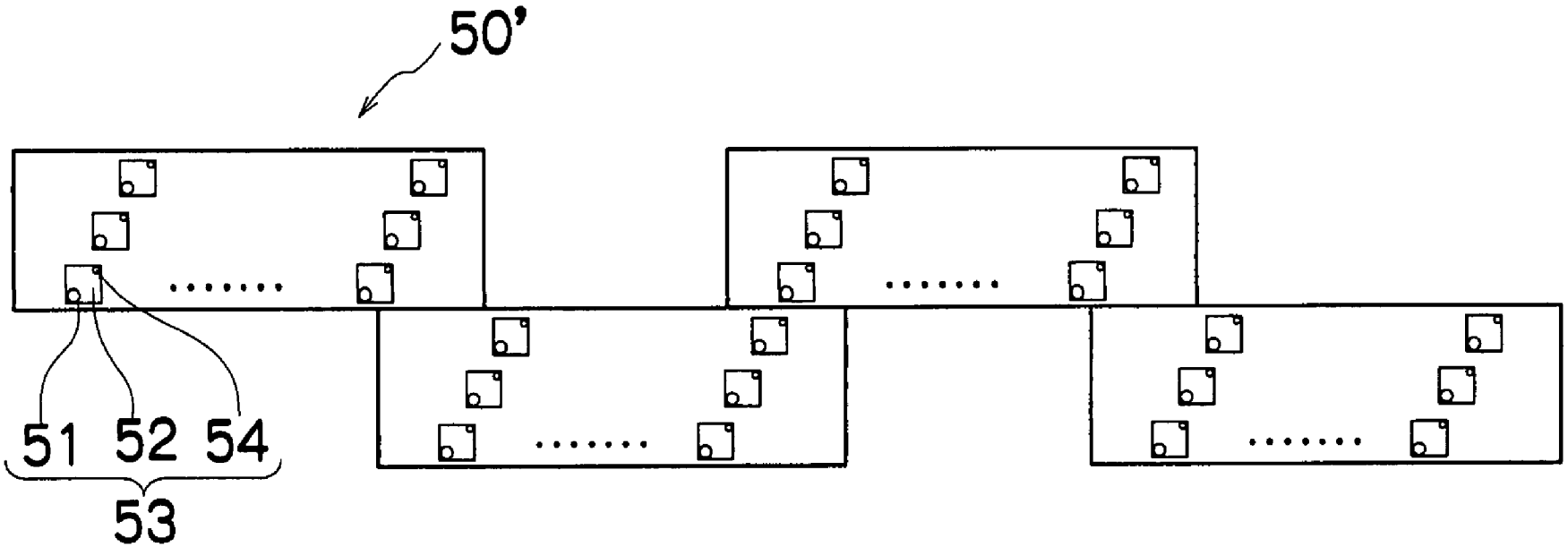
FIG. 3C is a perspective plan view showing another example of the configuration of the print head.
Figure 4:
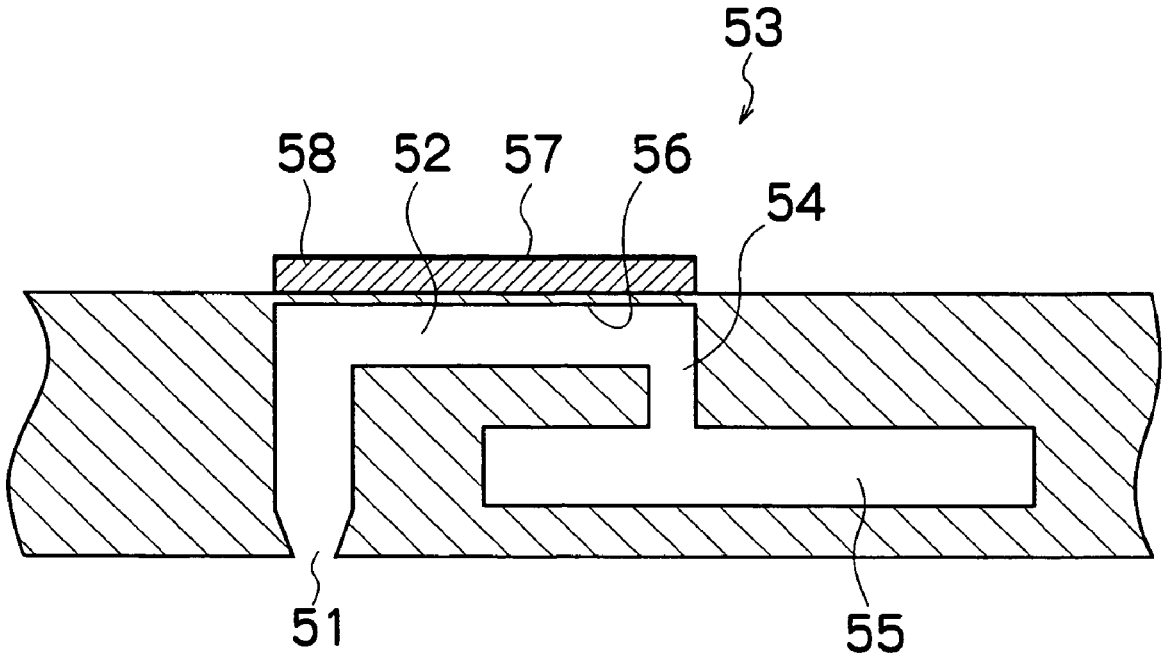
FIG. 4 is a cross-sectional view along a line 4-4 in FIGS. 3A and 3B.

FIG. 3A is a perspective plan view showing an example of the configuration of the print head 50, FIG. 3B is an enlarged view of a portion thereof, FIG. 3C is a perspective plan view showing another example of the configuration of the print head, and FIG. 4 is a cross-sectional view taken along the line 4-4 in FIGS. 3A and 3B, showing the inner structure of an ink chamber unit. The nozzle pitch in the print head 50 should be minimized in order to maximize the density of the dots printed on the surface of the recording paper. As shown in FIGS. 3A, 3B, 3C and 4, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

Thus, as shown in FIGS. 3A and 3B, the print head 50 in the present embodiment is a full-line head in which one or more of nozzle rows in which the ink discharging nozzles 51 are arranged along a length corresponding to the entire width of the recording medium in the direction substantially perpendicular to the conveyance direction of the recording medium.

Alternatively, as shown in FIG. 3C, a full-line head can be composed of a plurality of short two-dimensionally arrayed head units 50' arranged in the form of a staggered matrix and combined so as to form nozzle rows having lengths that correspond to the entire width of the recording paper 16.

The planar shape of the pressure chamber 52 provided for each nozzle 51 is substantially a square, and the nozzle 51 and an inlet of supplied ink (supply port) 54 are disposed in both corners on a diagonal line of the square. Each pressure chamber 52 is connected to a common channel 55 through the supply port 54.

An actuator 58 having a discrete electrode 57 is joined to a vibration plate 56, which forms the ceiling of the pressure chamber 52, and the actuator 58 is deformed by applying drive voltage to the discrete electrode 58 to eject ink from the nozzle 51. When ink is discharged, new ink is delivered from the common channel 55 through the supply port 54 to the pressure chamber 52.

Figure 5:
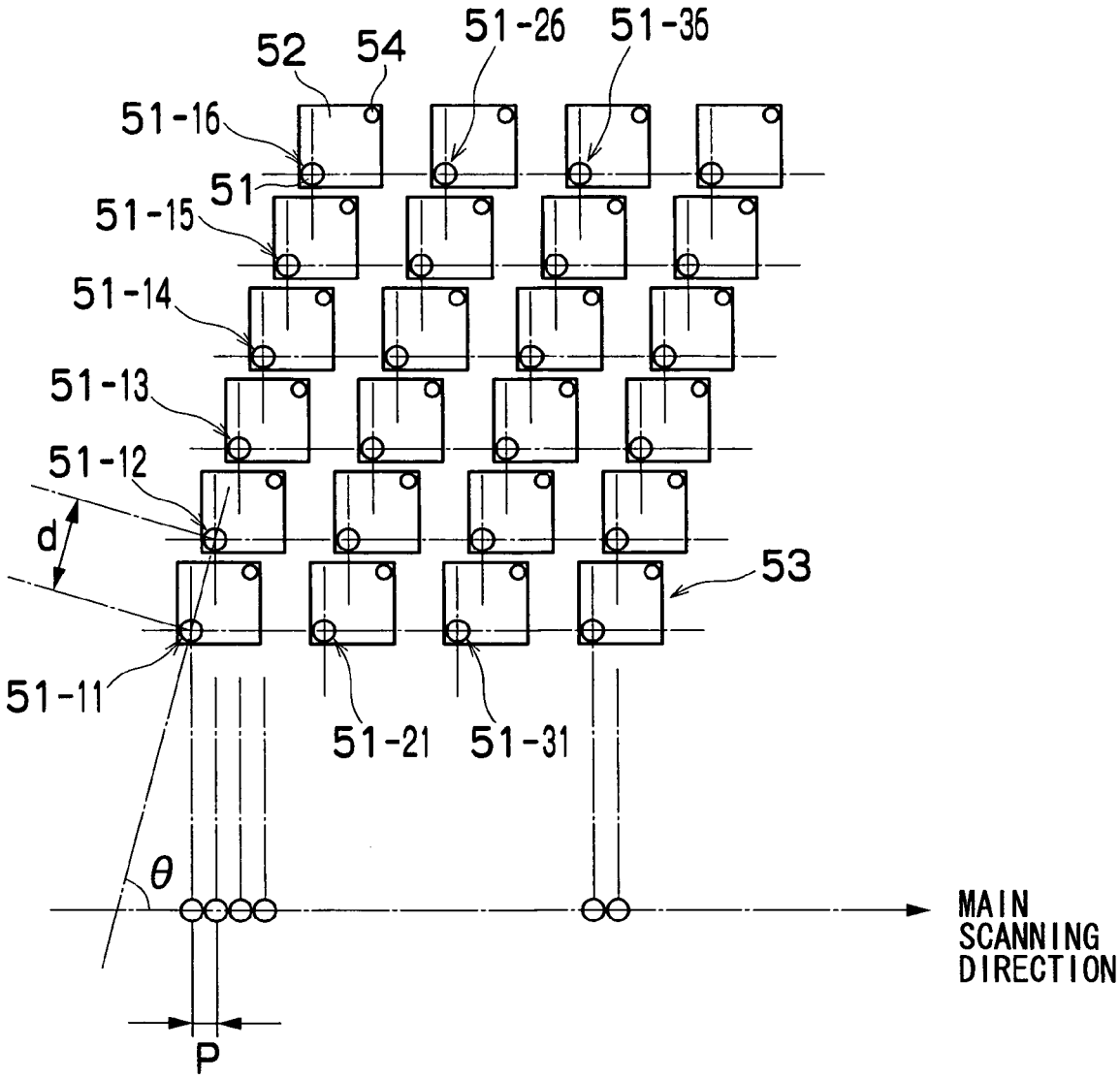
FIG. 5 is an enlarged view showing nozzle arrangement of the print head in FIG. 3A.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 5. With the structure in which the plurality of rows of ink chamber units 53 are arranged at a fixed pitch d in the direction at the angle θ with respect to the main scanning direction, the nozzle pitch P as projected in the main scanning direction is $d \times \cos\theta$.

Hence, the nozzles 51 can be regarded to be equivalent to those arranged at a fixed pitch P on a straight line along the main scanning direction. Such configuration results in a nozzle structure in which the nozzle row projected in the main scanning direction has a high nozzle density of up to 2,400 nozzles per inch (npi).

In a full-line head comprising rows of nozzles that have a length corresponding to the entire width of the paper (the recording paper 16), the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

In implementing the present invention, the arrangement of the nozzles is not limited to that of the example illustrated. Moreover, a method is employed in the present embodiment where an ink droplet is ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure of these bubbles.

Figure 6:
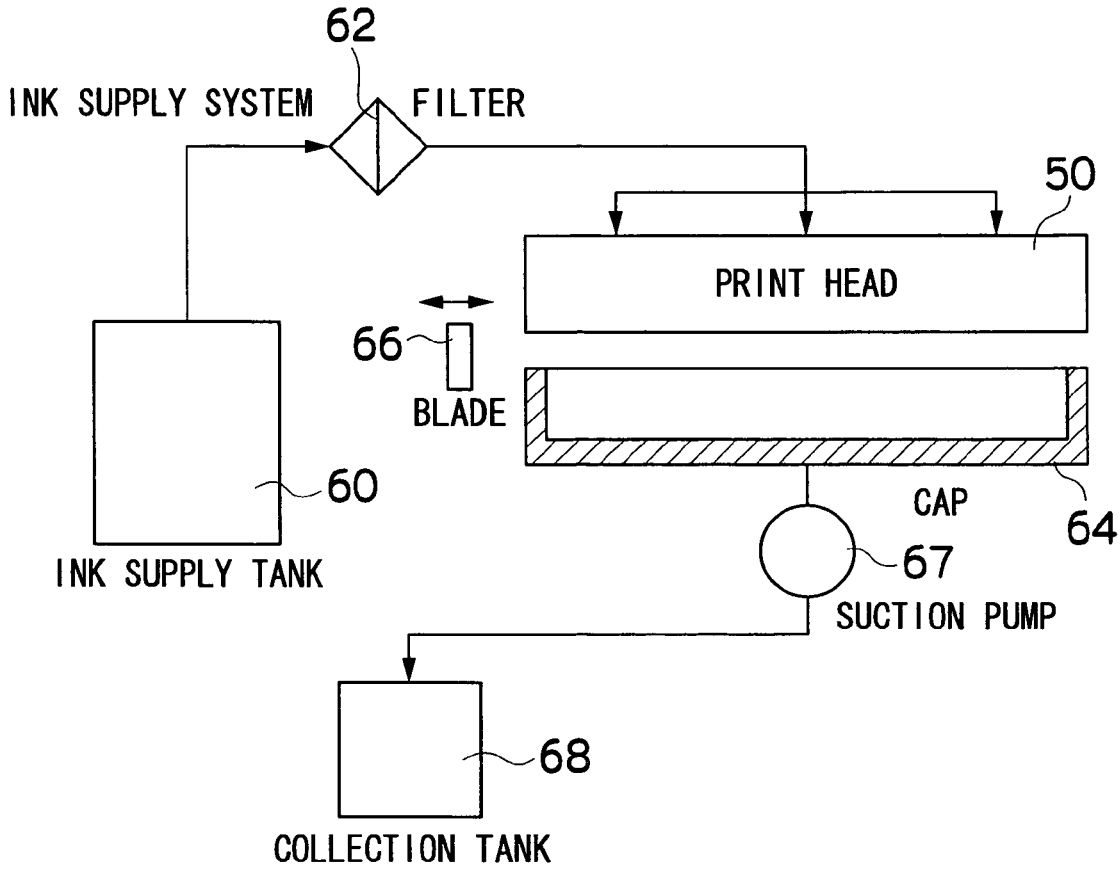
FIG. 6 is a schematic drawing showing a configuration of an ink supply system in the inkjet recording apparatus.

FIG. 6 is a schematic drawing showing the configuration of the ink supply system in the inkjet recording apparatus 10. An ink supply tank 60 is a base tank that supplies ink and is set in the ink storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing and loading unit 14 in FIG. 1 described above.

A filter 62 for removing foreign matters and bubbles is disposed between the ink supply tank 60 and the print head 50 as shown in FIG. 6. The filter mesh size in the filter 62 is preferably equivalent to or less than the diameter of the nozzle and commonly about 20 μm.

Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face. A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face is thereby covered with the cap 64.

The cleaning blade 66 is composed of rubber or another elastic member, and can slide on the ink discharge surface (surface of the nozzle plate) of the print head 50 by means of a blade movement mechanism (not shown). When ink droplets or foreign matter has adhered to the nozzle plate, the surface of the nozzle plate is wiped, and the surface of the nozzle plate is cleaned by sliding the cleaning blade 66 on the nozzle plate.

During printing or standby, when the frequency of use of specific nozzles is reduced and ink viscosity increases in the vicinity of the nozzles, a preliminary discharge is made toward the cap 64 to discharge the degraded ink.

Also, when bubbles have become intermixed in the ink inside the print head 50 (inside the pressure chamber), the cap 64 is placed on the print head 50, ink (ink in which bubbles have become intermixed) inside the pressure chamber is removed by suction with a suction pump 67, and the suction-removed ink is sent to a collection tank 68. This suction action entails the suctioning of degraded ink whose viscosity has increased (hardened) when initially loaded into the head, or when service has started after a long period of being stopped.

When a state in which ink is not discharged from the print head 50 continues for a certain amount of time or longer, the ink solvent in the vicinity of the nozzles 51 evaporates and ink viscosity increases. In such a state, ink can no longer be discharged from the nozzle 51 even if the actuator 58 is operated. Before reaching such a state the actuator 58 is operated (in a viscosity range that allows discharge by the operation of the actuator 58), and the preliminary discharge is made toward the ink receptor to which the ink whose viscosity has increased in the vicinity of the nozzle is to be discharged. After the nozzle surface is cleaned by a wiper such as the cleaning blade 66 provided as the cleaning device for the nozzle face, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be discharged by the preliminary discharge, and a suctioning action is carried out as follows.

More specifically, when bubbles have become intermixed in the ink inside the nozzle 51 and the pressure chamber 52, ink can no longer be discharged from the nozzles even if the actuator 58 is operated. Also, when the ink viscosity inside the nozzle 51 has increased over a certain level, ink can no longer be discharged from the nozzle 51 even if the actuator 58 is operated. In these cases, a suctioning device to remove the ink inside the pressure chamber 52 by suction with a suction pump, or the like, is placed on the nozzle face of the print head 50, and the ink in which bubbles have become intermixed or the ink whose viscosity has increased is removed by suction.

However, this suction action is performed with respect to all the ink in the pressure chamber 52, so that the amount of ink consumption is considerable. Therefore, a preferred aspect is one in which a preliminary discharge is performed when the increase in the viscosity of the ink is small.

Furthermore, although not illustrated in FIG. 6, the inkjet recording apparatus 10 comprises a treatment liquid supply system for supplying a treatment liquid to the treatment liquid applying unit 11 illustrated in FIG. 1. Similarly to the ink supply system illustrated in FIG. 6, the treatment liquid unit is constituted by a treatment liquid supply unit for storing the treatment liquid (indicated by reference symbol 11A in FIG. 10A), a flow channel for the treatment liquid, a filter disposed in the flow channel, a recovery tank for storing surplus treatment liquid that has been recycled, and the like.

Figure 7:
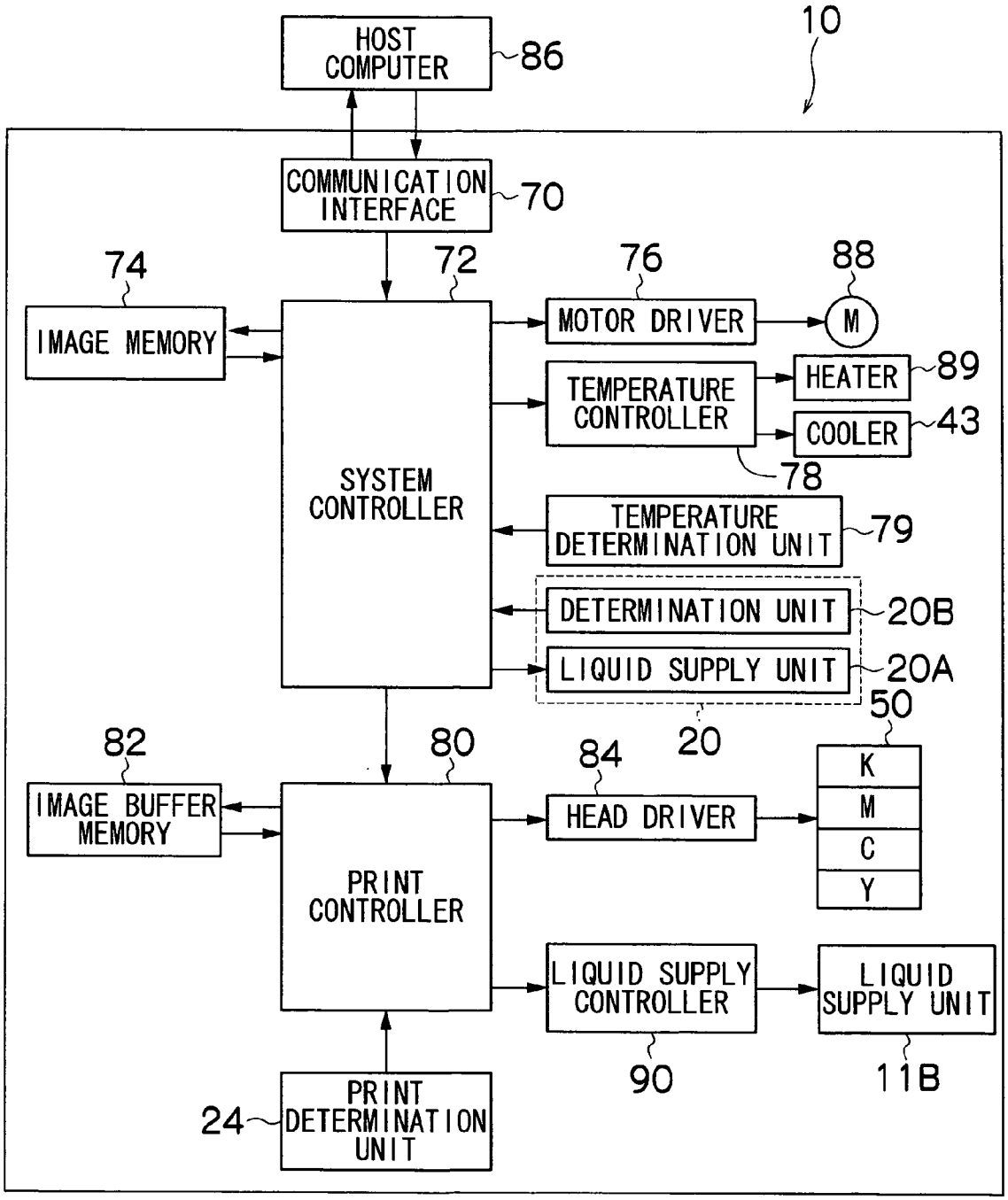
FIG. 7 is a principal block diagram showing the system composition of the inkjet recording apparatus.

FIG. 7 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling a heater 89 and the motor 88 in the conveyance system.

The motor driver (drive circuit) 76 drives the motor 88 in accordance with commands from the system controller 72. The temperature controller 78 drives the cooler 43 and the heater 89 of the post-drying unit 44 or the like in accordance with commands from the system controller 72.

The temperature determination unit 79 is constituted by a temperature sensor which determines the temperature of the recording paper 16 or the temperature of the print head 50, a signal processing unit which carries out prescribed signal processing (noise reduction, amplification, and the like) with respect to the determination signal obtained by the temperature sensor, and the like. The temperature information obtained from the temperature determination unit 79 is supplied to the system controller 72, and the system controller 72 sends a control signal to the temperature controller 78 in such a manner that the temperatures of the respective sections assume prescribed temperatures.

The print control unit 80 is a control unit having a signal processing function for performing various treatment processes, corrections, and the like, in accordance with the control implemented by the system controller 72, in order to generate a signal for controlling printing, from the image data in the image memory 74, and it supplies the print control signal (image data) thus generated to the head driver 84. Prescribed signal processing is carried out in the print control unit 80, and the discharge amount and the discharge timing of the ink droplets from the respective print heads 50 are controlled via the head drier 84, on the basis of the image data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators 58 for the print heads 12K, 12M, 12C, and 12Y of the respective colors on the basis of the print data received from the print controller 80. A feedback control system for keeping the drive conditions for the print heads constant may be included in the head driver 84.

Various control programs are stored in a program storage section (not illustrated), and a control program is read out and executed in accordance with commands from the system controller 72. The program storage section may use a semiconductor memory, such as a ROM, EEPROM, or a magnetic disk, or the like. An external interface may be provided, and a memory card or PC card may also be used. Naturally, a plurality of these storage media may also be provided.

The program storage section may also be combined with a storage device for storing operational parameters, and the like (not illustrated).

The system controller 72 judges the permeation speed of the liquid droplets on the basis of the determination signal supplied from the determination unit 20B of the permeation speed measurement unit 20, and controls the application of treatment liquid and the ejection of droplets from the print head 50 in accordance with the permeation speed judgment information.

The application of the treatment liquid is controlled by controlling the amount of the treatment liquid and the supply speed of the liquid supplied to the roller (indicated by reference numeral 11A in FIGS. 10A and 10B) by the liquid supply controller 90. Furthermore, the speed of rotation of the roller and the speed of movement of the recording paper 16 during application of the treatment liquid are also controlled. The motor 88 illustrated in FIG. 7 includes a motor for rotating the roller and the motor for driving the movement device of the recording paper 16. The details of the control of application of the treatment liquid and the control of droplet ejection in accordance with the permeation speed are described hereafter.

As shown in FIG. 1, the print determination unit 24 is a block including a line sensor, which reads in the image printed onto the recording paper 16, performs various signal processing operations, and the like, and determines the print situation (presence/absence of discharge, variation in droplet ejection, etc.), these determination results being supplied to the print controller 80.

Furthermore, according to requirements, the print controller 80 makes various corrections with respect to the print head 50 on the basis of information obtained from the print determination unit 24.

In the example shown in FIG. 1, the print determination unit 24 is provided on the print surface side, the print surface is irradiated with a light source (not illustrated), such as a cold cathode fluorescent tube disposed in the vicinity of the line sensor, and the reflected light is read in by the line sensor. However, in implementing the present invention, another composition may be adopted.

Liquid Application Control and Droplet Ejection Control

Next, the control of the application of treatment liquid and the control of ink droplet ejection in the inkjet recording apparatus 10 will be described.

As described above, the inkjet recording apparatus 10 forms images by means of a liquid which combines two types of liquids. The inkjet recording apparatus 10 has a function for measuring the permeation speed of the liquid on the recording paper 16, and it controls the amount of treatment liquid applied, the treatment liquid being one of the two types of liquid, and the amount of the ejected ink droplets, the ink being the other type of liquid, on the basis of these measurement values (judgment values). Furthermore, in the case of a recording medium with extremely slow permeation characteristics, control is implemented in order to reduce the drying load by suctioning away the residual water content.

Figure 8:
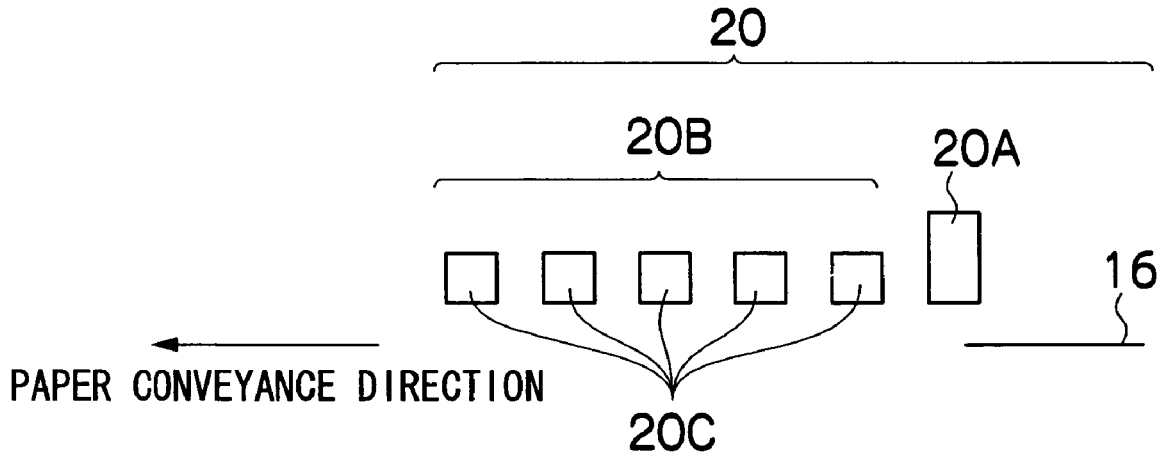
FIG. 8 is a general schematic drawing showing the composition of a permeation speed measurement unit.

FIG. 8 is a block diagram showing the details of the permeation speed measurement unit 20 illustrated in FIG. 1.

In the upstream portion of the determination region 41 illustrated in FIG. 1, several droplets of liquid are supplied to the recording paper 16 by the liquid supply unit 20A, which supplies liquid droplets in order to judge the permeation speed. If the permeation speed of the treatment liquid applied to the recording paper 16 is to be judged by means of the treatment liquid applying unit 11, then the treatment liquid is supplied to the recording paper 16 by the liquid supply unit 20A. Of course, it is also possible to judge the permeation speed of the ink that is to be discharged by the print head 50, and in this case, the ink is supplied to the recording paper 16 by the liquid supply unit 20A.

An inkjet head or a miniature syringe may be used for the liquid supply unit 20A. Several liquid droplets should be supplied to the recording paper 16.

Sensors 20C including a light source and a light receiving section are provided at a plurality of positions on the downstream side of the liquid supply unit 20A, and the amount of light reflected by the surface of the liquid droplets is determined by these sensors. While the liquid droplets are present on the surface of the recording paper 16, a glossy reflection signal is detected by the light receiving sections, and when the liquid droplets are no longer present on the surface of the recording paper 16, then the glossy reflection signal ceases to be detected.

The recording paper 16 moves over the determination surfaces of the sensors 20C, and the time required for the liquid to permeate (namely, the permeation speed) is judged from the time (or position) at which the determination signal from the sensors 20C ceases to be received. If the recording paper 16 is set to a slow movement speed, then it is possible to judge the permeation speed over a long time range.

FIG. 8 shows a mode where sensors 20C are arranged in a plurality of positions, but it is also possible to provide only one sensor 20C and to obtain a determination signal from the sensor 20C at uniform time intervals. Furthermore, a composition may be adopted in which the recording paper 16 is fixed in position and the sensors 20C scan over the recorded surface of the paper (the surface to which liquid droplets have been supplied).

For example, an imaging element such as a CCD may be provided instead of the sensors 20C, and the speed of bleeding and spreading may be judged by substituting the sensors for CCDs in the system for judging liquid permeation described above.

Figure 9:
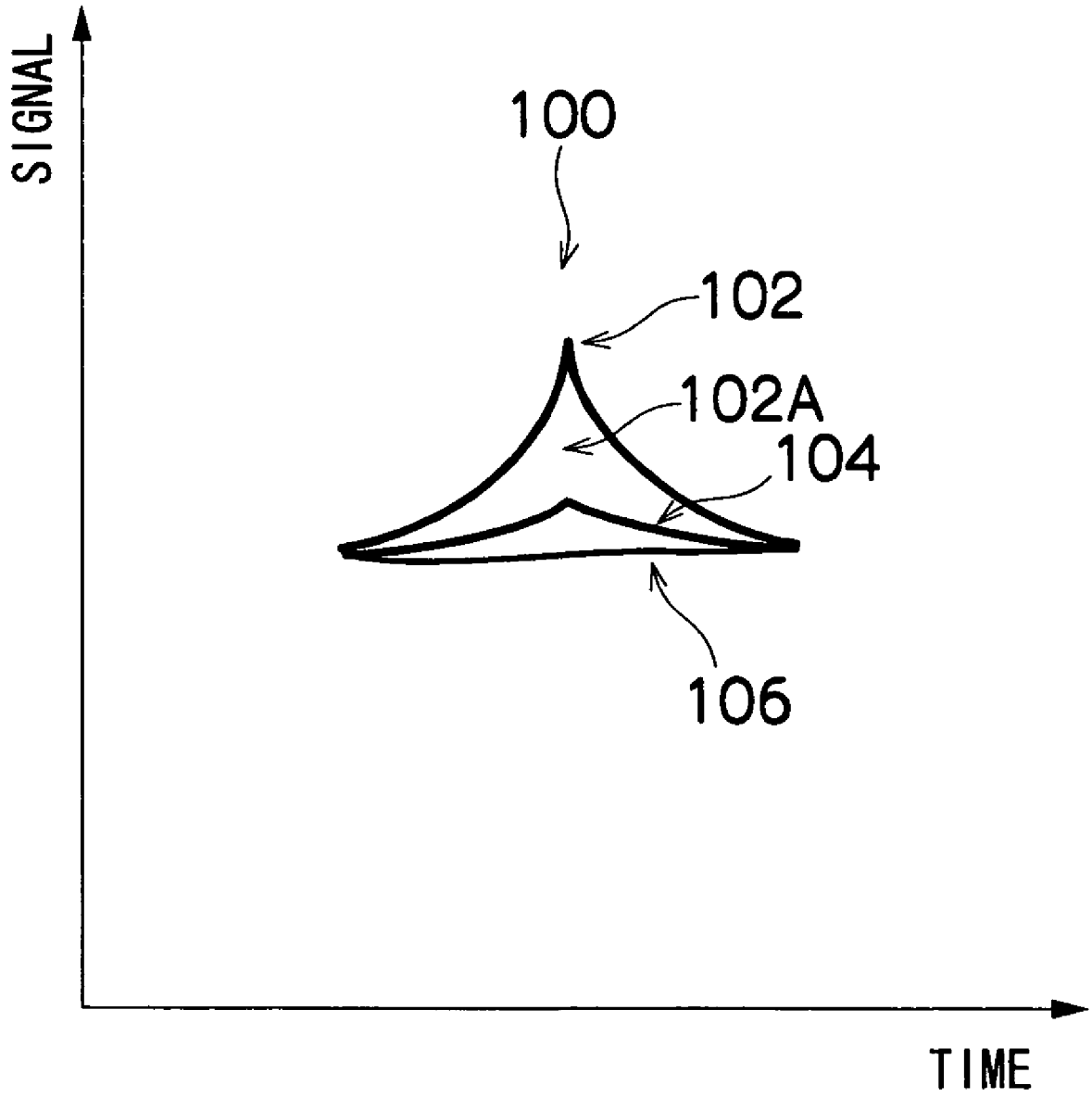
FIG. 9 is a diagram showing one example of a determination signal obtained from a sensor provided in the permeation speed measurement unit.

FIG. 9 shows one example of a determination signal obtained from the sensor 20C. FIG. 9 shows the temporal change (signal waveform) 100 of the determination signal obtained when determining liquid droplets in a non-permeated state. A liquid droplet which is in a non-permeated state is determined by a signal having at least one peak (point of change) 102, such as the signal waveform 100. On the other hand, the determination signal for a liquid droplet that has proceeded to permeate to a certain degree is like signal waveform 104 which has a smaller peak 102A than the peak 102 in signal waveform 100. Furthermore, if permeation has completed and there is no liquid droplet on the surface of the recording paper 16, then a signal waveform 106 is obtained which has no peak 102 like that indicated in signal waveform 100.

Figure 10A:
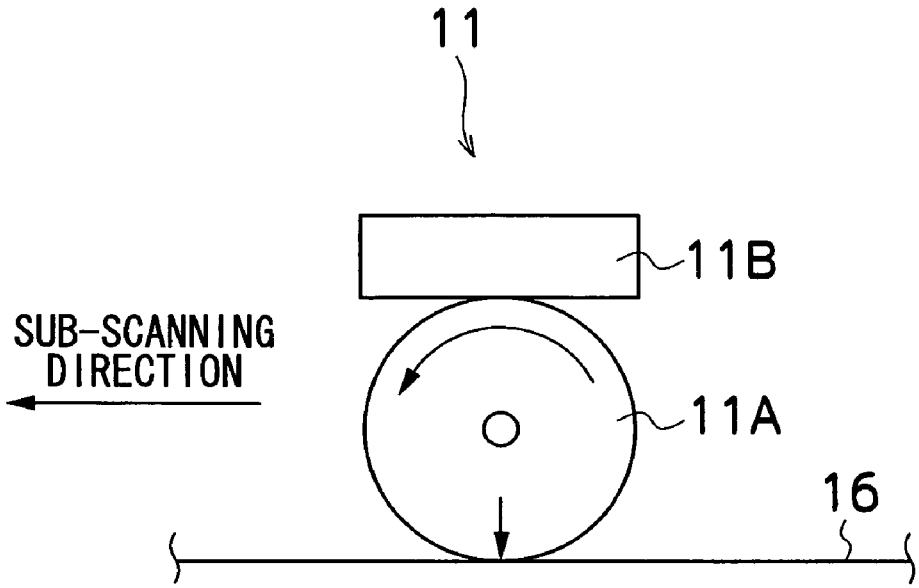
FIGS. 10A and 10B are general schematic drawings showing the composition of a liquid application unit.
Figure 10B:
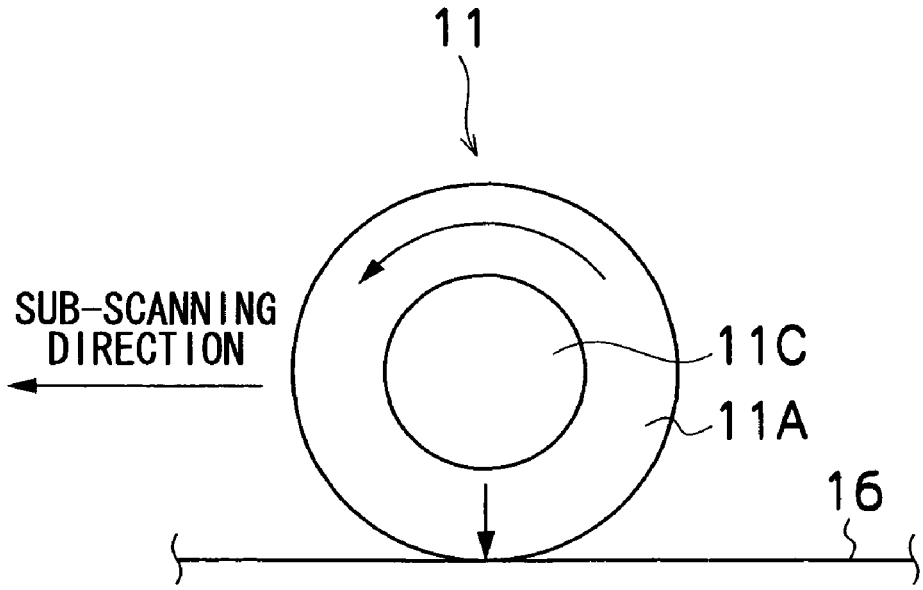

FIGS. 10A and 10B show a treatment liquid applying unit 11 including a roller 11A such as that illustrated in FIG. 1. The treatment liquid applied to the recording paper 16 by the treatment liquid applying unit 11 reacts by mixing with the colored ink containing coloring material (dye) discharged from the print head 50, and thus ensures the insolubility and fixing characteristics of the coloring material.

The treatment liquid is a transparent liquid which is applied to one surface of the recording paper 16 (namely, the image forming surface, or recording surface), regardless of the image information.

In the mode illustrated in FIG. 10A, a roller 11A having a surface width approximately equal to the width of the recording paper is pressed against the surface of the recording paper 16, and hence treatment liquid is applied to the entire width of the recording paper 16. By conveying the recording paper 16 in the recording paper conveyance direction, treatment liquid is applied to the whole surface of the recording paper 16. The treatment liquid is supplied to the roller 11A from a treatment liquid supply unit 11B.

It is also possible to provide a roller movement device which moves the roller 11A in the recording paper conveyance direction, instead of moving the recording paper 16 in the recording paper conveyance direction.

Furthermore, a liquid supply unit 11B for supplying treatment liquid to the roller 11A is provided at the surface of the roller 11A on the opposite side to the recording paper 16. The liquid supply unit 11B may be disposed in any position, provided that it is outside the region where the treatment liquid is applied to the recording paper 16.

FIG. 10B shows a mode where a supply tube 11C is provided at the center of rotation of the roller 11A, as a device for supplying treatment liquid to the roller 11A.

The rollers illustrated in FIGS. 10A and 10B should be made of a flexible porous material, such as sponge, or nonwoven cloth, or the like, having flexibility in order to absorb undulations in the surface of the recording paper 16 and hence being able to apply an approximately uniform application of treatment liquid onto the surface of the recording paper 16, regardless of the undulations in the recording paper 16, as well as properties for soaking up a prescribed amount of liquid.

Here, the amount of treatment liquid applied to the recording paper 16 by the roller 11A is varied in accordance with the permeation speed of the treatment liquid measured by the permeation speed measurement unit 20 illustrated in FIG. 1. More specifically, if the treatment liquid permeates rapidly, the amount of treatment liquid applied is controlled so as to be a large amount, whereas if the treatment liquid permeates slowly, the amount of treatment liquid applied is controlled to be a small amount. Thereby, a prescribed amount of treatment liquid can be caused to remain on the surface of the recording paper 16 until the time at which the ink droplets are ejected from the print head 50. The permeation speed of the treatment liquid varies with the type of recording paper 16 (the media type).

In order to vary the amount of liquid applied to the recording paper 16, it is possible to control the speed of rotation of the roller 11A and it is also possible to control the pressure with which the roller 11A presses against the recording paper 16, for example.

Furthermore, if a material such as a porous member is used as the roller 11A which applies the treatment liquid to the recording paper 16, then a highly viscose liquid, which is difficult to eject as droplets from a print head 50 illustrated in FIG. 1 and other drawings, can be applied to the recording paper 16. By setting the treatment liquid to a higher viscosity than the ink, it is possible to slow the permeation speed of the treatment liquid into the recording paper 16, and hence ink can be deposited onto the recording paper 16 before the treatment liquid has permeated completely into the recording paper 16 (while there is still treatment liquid remaining on the surface of the recording paper 16). In other words, the time from the application of the treatment liquid to the recording paper 16 until the deposition of ink onto the recording paper 16 can be increased.

When the recording paper 16 to which the treatment liquid has been applied by the treatment liquid applying unit 11 is conveyed to the printing region of the print head 50, droplets of colored ink including coloring material are ejected from the print head 50 in accordance with the image information. When colored ink lands on the recording paper 16, this colored ink reacts with the previously applied treatment liquid and the insolubility and fixing characteristics of the ink are ensured.

Furthermore, the liquid amount ejected as droplets from the print head 50 is varied on the basis of the permeation speed judgment information obtained from the permeation speed measurement unit 20, in such a manner that the amount of the ejected droplets are suited to the permeation speed. In the print controller 80 illustrated in FIG. 7, the image data is processed in such a manner that the image data is recomposed in accordance with the permeation speed.

In one example for ensuring the insolubility and fixing characteristics of the ink coloring material, a transparent liquid containing at least a cationic polymer is used as the treatment liquid, and an ink containing at least an anionic polymer is used as the colored ink. Of course, it is possible to achieve insolubility and fixing of the ink coloring material by means of other combinations of liquids.

In the inkjet recording apparatus 10, the permeation speed of the treatment liquid is measured by a permeation speed measurement unit 20, and on the basis of this measurement result, at least one of the following types of control is implemented: namely, treatment liquid application control for controlling the amount of treatment liquid applied to the paper; droplet ejection control for controlling the amount of the ejected droplets of ink; temperature control for controlling the temperature of the recording paper 16; and conveyance control for controlling the conveyance speed of the recording paper 16.

More specifically, the applied amount of treatment liquid and the amount of the ejected ink droplets are optimized in accordance with the treatment liquid permeation speed (permeation speed judgment information) determined by the permeation speed measurement unit 20. Furthermore, the viscosity of the liquid applied to (or deposited onto) the recording paper 16 can be varied by controlling the temperature of the recording paper 16. For example, if the temperature of the recording paper 16 is raised, then the viscosity of the liquid on the surface of the recording paper 16 becomes lower (in other words, the liquid becomes softer), and the permeation speed of the liquid increases. On the other hand, if the temperature of the recording paper 16 is reduced, then the viscosity of the liquid on the recording paper 16 increases and the permeation speed of the liquid declines.

In order to control the temperature of the recording paper 16, it is possible to blow a warm air flow onto the recording paper 16 by means of a heater 40, or it is possible to provide a temperature adjustment device, such as a heater, cooling pipe (for example, the cooling 43 shown in FIG. 1), or the like, in the belt 33.

Furthermore, by controlling the speed of the suction belt conveyance unit 22, it is possible to control the time from the application of the treatment liquid until the ejection of ink droplets.

In this way, by varying the temperature of the recording paper 16, it is possible to control the permeation speed of the treatment liquid present on the recording paper 16.

Furthermore, by controlling the conveyance speed of the recording paper 16, it is possible to control the time period until the recording paper 16 onto which treatment liquid has been applied reaches the print region of the print head 50.

More specifically, at the time that the ink droplets ejected from the print head 50 land on the recording paper 16, the permeation of the treatment liquid applied previously to the recording paper 16 will not have been completed, and a prescribed quantity of treatment liquid will be remaining on the surface of the recording paper 16. Furthermore, in order to prevent decline in the ink concentration caused by variation in the amount of treatment liquid applied to the paper, and hence to ensure that dots of a prescribed concentration are formed, it is necessary increase the amount of the ink droplets ejected by the print head 50.

Figure 11A:
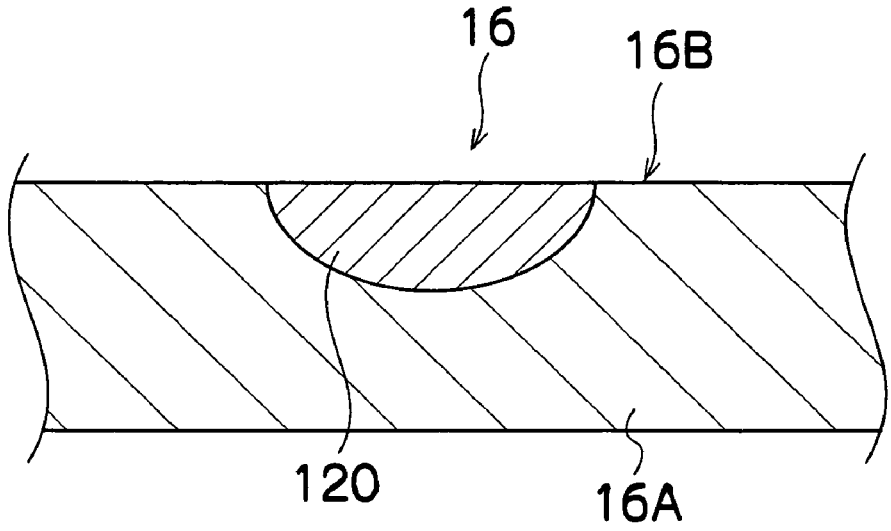
FIGS. 11A and 11B are diagrams showing dots formed on permeable paper and non-permeable paper.
Figure 11B:
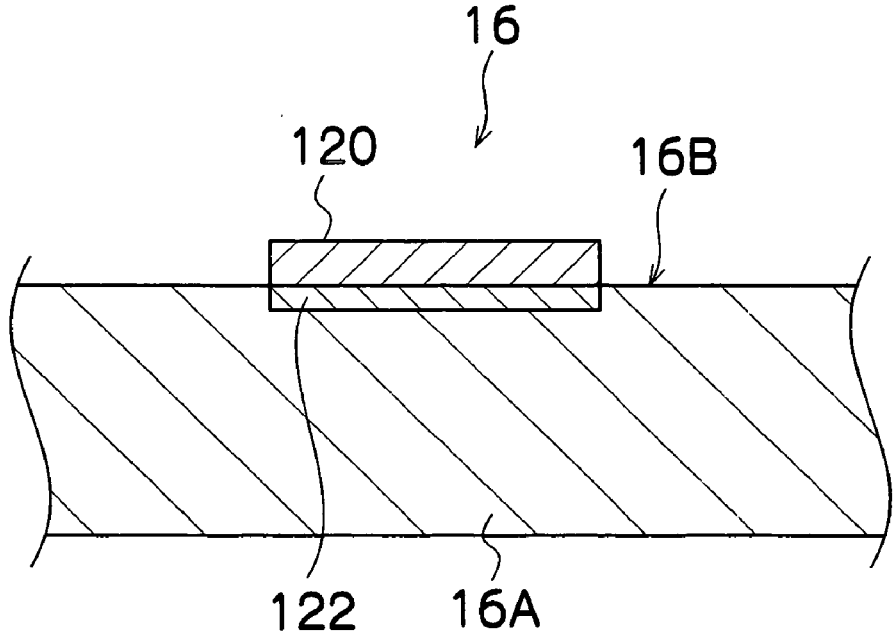

Here, the recording paper 16 may be permeable paper as illustrated in FIG. 11A on which a dot 120 is formed by means of the coloring material permeating into the interior 16A of the recording paper 16 and becoming fixed therein, or it may be a non-permeable paper as illustrated in FIG. 11B on which a dot 120 is formed by means of the coloring material becoming fixed principally on the surface 16B of the recording paper 16. Moreover, even in the case of non-permeable paper, a portion of the ink (coloring material) permeates into the paper, as indicated by reference numeral 122 in FIG. 11B. FIGS. 11A and 11B shows a cross-sectional diagram of recording paper 16.

At the time that the ink discharged from the print head 50 lands on the recording paper 16, the treatment liquid previously applied to the surface 16B of the recording paper 16 by the treatment liquid applying unit 11 illustrated in FIG. 1 must remain at least partially on the surface 16B of the recording paper 16, rather than having permeated completely into the paper.

Figure 12A:
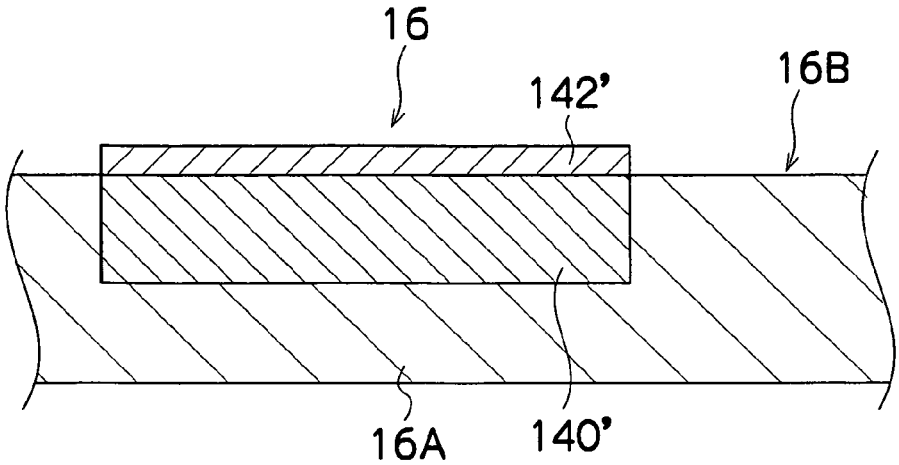
FIGS. 12A, 12B and 12C are diagrams illustrating permeable paper and non-permeable paper.

However, in the case of a medium having a high permeation speed, the treatment liquid may permeate completely into the interior 16A of the recording paper 16, as shown in FIG. 12A. Incidentally, reference numeral 140 in FIG. 12A indicates treatment liquid that has permeated into the interior 16A of the recording paper 16.

Consequently, in a medium having high permeation speed, it is necessary either to apply a large amount of treatment liquid, or to increase the viscosity of the liquid, thereby slowing the permeation of the liquid into the paper, or to increase the speed of conveyance of the recording paper 16 in such a manner that the recording paper 16 to which the treatment liquid has been applied reaches the print region of the print head 50 before the treatment liquid has permeated completely.

Figure 12B:
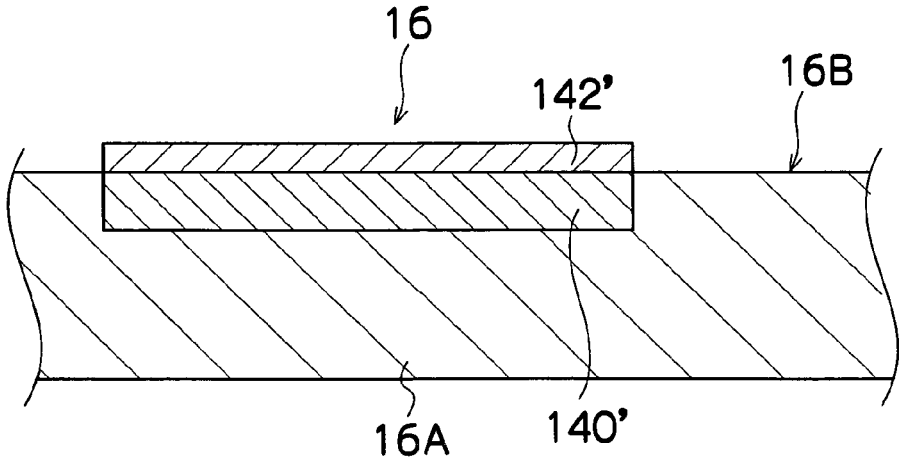

With the non-permeable paper illustrated in FIG. 12B, a portion of the treatment liquid permeates into the interior 16A of the recording paper 16, but almost all of the treatment liquid applied to the paper remains on the surface 16B of the recording paper 16. Even when non-permeable paper is used, desirably, the amount of treatment liquid applied is varied in accordance with the permeation speed. Reference numeral 140 shown in FIG. 12B indicates treatment liquid which has permeated inside the recording paper 16, and reference numeral 142 indicates treatment liquid remaining on the surface 16B of the recording paper 16. The thickness (depth) of the treatment liquid that has permeated into the paper and the thickness of the treatment liquid remaining on the surface in FIGS. 12A to 12C correspond respectively to the amounts of treatment liquid that has permeated and treatment liquid remaining on the surface.

Figure 12C:
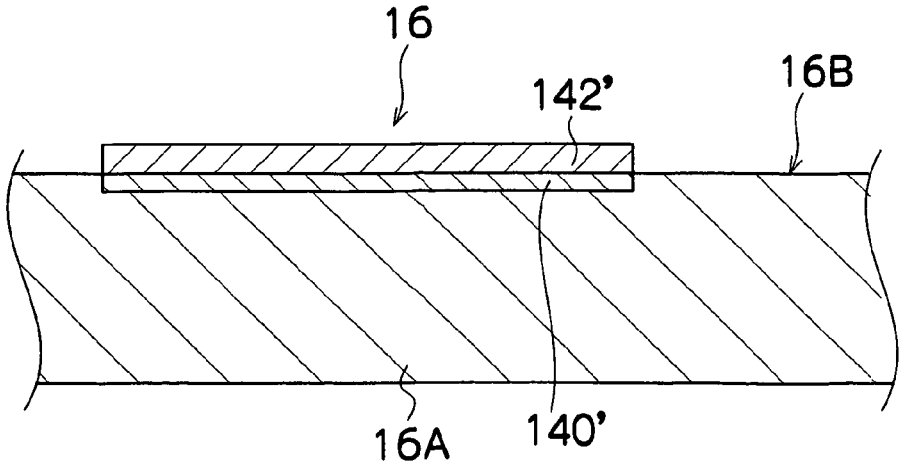
Figure 13A:
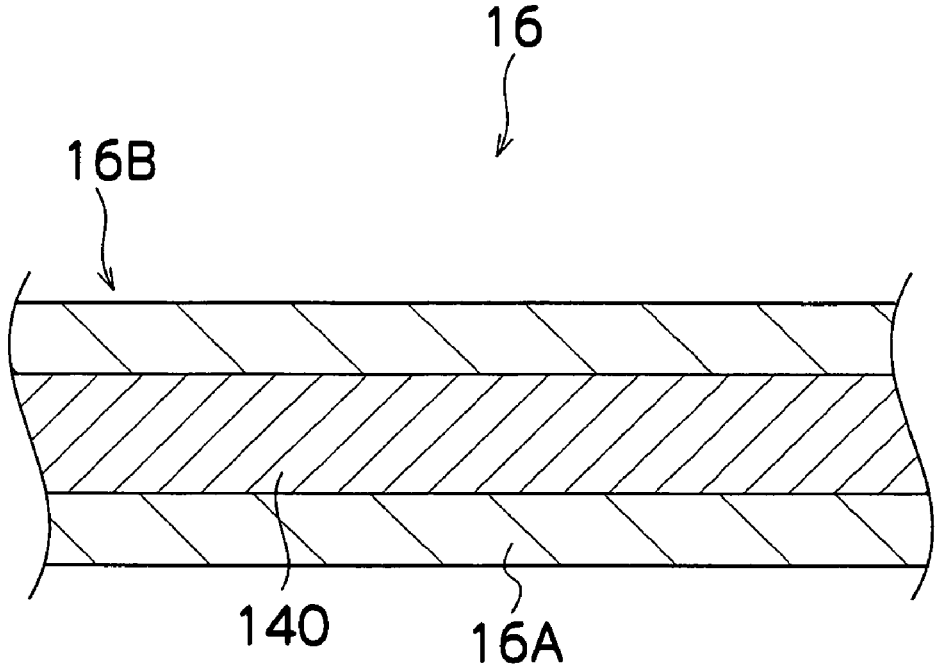
FIGS. 13A and 13B are diagrams showing the state of permeation of a treatment liquid applied in accordance with the droplet ejection control relating to the present invention.
Figure 13B:
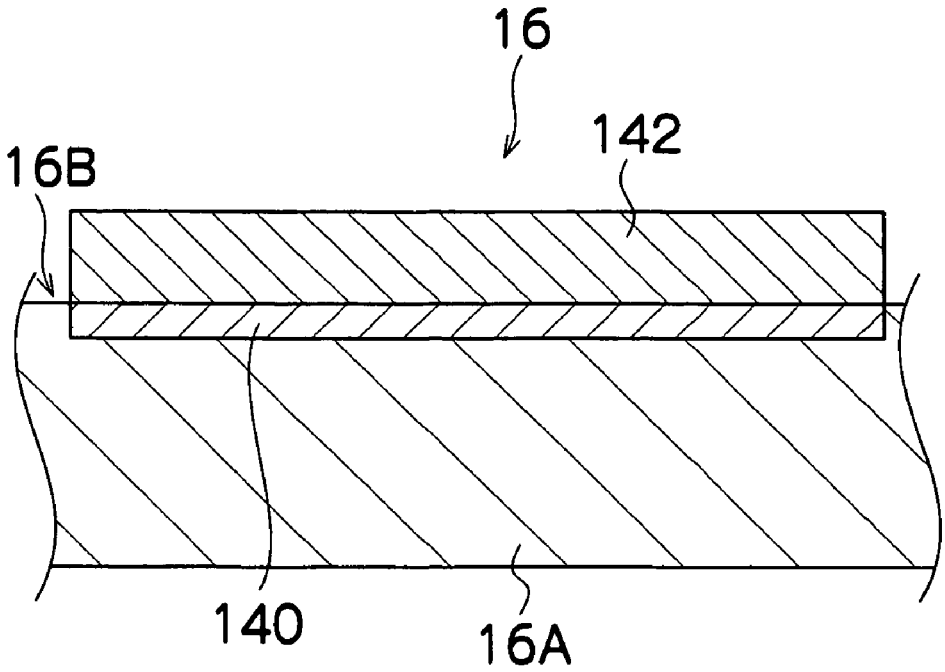

FIG. 13A shows a mode where a prescribed amount of treatment liquid is left on the surface of the recording paper 16 by increasing the amount of treatment liquid applied, when a permeable paper is used. Reference numeral 140' indicates treatment liquid that has permeated into the interior 16A of the recording paper 16, and reference numeral 142' indicates treatment liquid that remains on the surface 16B of the recording paper 16. In FIGS. 13A and 13B, items which are the same as or similar to those in FIGS. 12A to 12C are labeled with the same reference numerals and description thereof is omitted here.

FIG. 13B shows a mode where the temperature of the recording paper 16 is lowered, thereby increasing the viscosity of the treatment liquid on the recording paper 16 and slowing the permeation speed of the treatment liquid, when a permeable paper is used. In this way, it is possible to cause a prescribed amount of treatment liquid (namely, an amount which ensures the insolubility and fixing characteristics of the coloring material in the ink by reacting with the ink ejected from the print head 50) to remain on the surface 16B of the recording paper 16 until the ink droplets ejected by the print head 50 land on the surface 16B of the recording paper 16, without having to increase the amount of treatment liquid applied to the paper.

FIG. 13C shows a mode where a prescribed amount of treatment liquid is applied to the surface 16B of the recording paper 16, when a non-permeable paper is used. Even with a non-permeable paper, a portion of the treatment liquid permeates into the interior 16A of the recording paper 16, and therefore it is desirable that the amount of treatment liquid applied be changed in accordance with the permeation speed. Reference numeral 140' indicates treatment liquid that has permeated into the interior 16A of the recording paper 16, and reference numeral 142' indicates treatment liquid that remains on the surface 16B of the recording paper 16.

If the amount of treatment liquid remaining on the surface of the recording paper varies, then the reaction time between the two liquids (the treatment liquid and the ink) also varies, and hence the spreading of the liquid when the ink becomes fixed (namely, the dot diameter) varies. Therefore, image processing is carried out in order to form desirable images in accordance with the permeation speed of the treatment liquid into the recording paper 16 and the amount of treatment liquid applied. The ejection of droplets by the print head 50 is controlled in accordance with this image processing.

More specifically, the two principal trends are: (1) there is too much remaining treatment liquid, and hence the reaction time is too short, and therefore and the fixed dot diameter is small; and (2) there is too little remaining treatment liquid, and hence the reaction time is too long, and therefore the fixed dot diameter is large. Taking these trends into account, the ink droplet ejection data is calculated by processing the image data in such a manner that an image of the desired concentration is achieved.

After forming an image on the recording paper 16, surplus liquid (principally treatment liquid which has not reacted with the ink) may remain on the surface 16B of the recording paper 16. In the present inkjet recording apparatus 10, the amount of surplus liquid at the time that ejection of ink droplets is completed (in other words, when image formation has completed), is predicted from the amount of treatment liquid applied and the amount of the ejected ink droplets, on the basis of permeation speed judgment information obtained by the permeation speed measurement unit 20. If this predicted value exceeds a previously established threshold value, then the surplus liquid is recovered by means of the surplus liquid recovery unit 42 illustrated in FIG. 1.

On the other hand, if the predicted value does not exceed the established threshold value, then control is implemented in such a manner that the surplus liquid is not recovery by the surplus liquid recovery unit 42.

The liquid (water content) which cannot be recovered by the surplus liquid recovery unit 42, and the water content inside the recording paper 16 are removed by drying in the post drying unit 44 disposed at a subsequent stage.

Figure 14A:
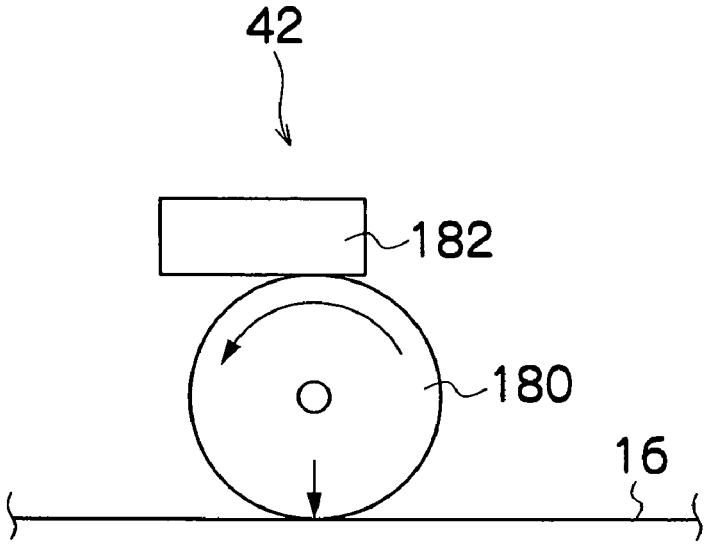
FIGS. 14A and 14B are general schematic drawings showing the composition of a surplus liquid recovery unit.
Figure 14B:
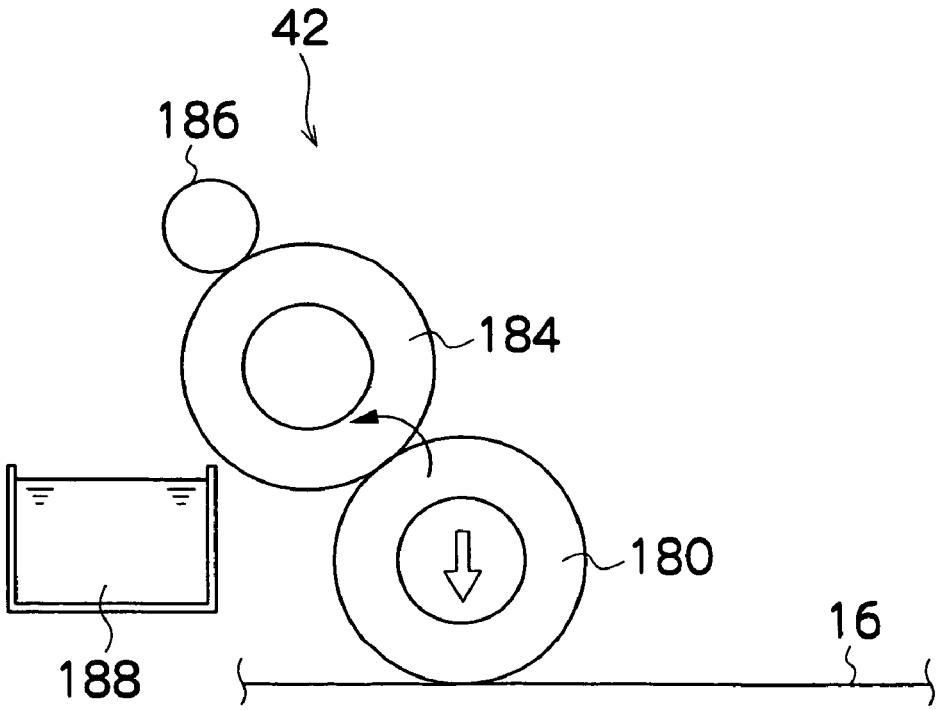

FIGS. 14A and 14B are general schematic drawings of a surplus liquid recovery unit 42.

As shown in FIG. 14A, the surplus liquid recovery unit 42 presses a roller 180 made of a porous member against the surface of the recording paper 16, while rotating the roller 180, thus causing the surplus liquid on the recording paper 16 to be absorbed into the roller 180. On the other hand, if recovery of surplus liquid is not to be carried out, then the roller 180 is moved to a position where it is not pressed against the surface of the recording paper 16.

In order to switch between a pressing and a non-pressing state of the roller 180, it is possible to adopt a composition in which the roller 180 is pressed against the recording paper 16 by means of an impelling member when in a pressing state, and in which the impelling force of the impelling member is released when in a non-pressing state. It is also possible to provide a movement device for moving the roller 180. The impelling member and the movement device are controlled by a system control routine included in the system controller 72 illustrated in FIG. 7.

Furthermore, in order to maintain the liquid suction characteristics of the roller 180 and to clean the absorbent surface of the roller 180, a roller cleaning unit 182 is provided which recovers surplus liquid absorbed by the roller 180 and removes foreign matter adhering to the surface of the roller 180.

FIG. 14B shows a further mode of the surplus liquid recovery unit 42.

In the mode shown in FIG. 14B, the roller cleaning unit 182 comprises a cleaning roller 184 which has greater liquid absorbing properties than the roller 180 and which makes contact with the roller 180 in such a manner that foreign matter adhering to the surface of the roller 180 and surplus liquid absorbed by the roller 180 are transferred to the cleaning roller 184, a squeezing roller 186 which presses against the surface of the cleaning roller 184, thus removing the foreign matter adhering to the surface of the cleaning roller 184 and squeezing the liquid absorbed by the cleaning roller 184, and a surplus liquid tank 188 for collecting the liquid recovered from the cleaning roller 184. Furthermore, even in the mode illustrated in FIG. 14B, if surplus liquid is not to be recovered, then the roller 180 is moved from the surface of the recording paper.

Apart from a flexible porous material, it is also possible to use a nonwoven cloth material, or the like, for the roller 180, and the cleaning roller 184 illustrated in FIG. 14B. Furthermore, the squeezing roller 186 may be a blade.

By recovering the surplus liquid by means of the surplus liquid recovery unit 42, it is possible to ensure that the post drying unit 44 disposed at a subsequent stage to the surplus liquid recovery unit 42 does not have to perform more drying than necessary, and hence the load on the post drying unit 44 can be reduced.

The present embodiment has been described with respect to a mode where permeation speed judgment information is obtained by measuring the permeation speed of the treatment liquid by means of a permeation speed measuring unit 20 as illustrated in FIG. 1 and FIG. 8, but it is also possible to adopt a composition in which permeation speed judgment information corresponding to a plurality of types of media is previously recorded in a database with respect to different types of treatment liquid, in such a manner that the permeation speed judgment information can be obtained subsequently from the database by referring to the type of medium and type of treatment liquid used. A composition should be provided whereby, if the medium or treatment liquid used is not one recorded in the database, then the permeation speed judgment information can be obtained by measuring the actual permeation speed.

Desirably, if a new permeation speed measurement is carried out, then it should be possible to register the permeation speed judgment information for the relevant medium and treatment liquid in the database.

For the recording device for recording this database, it is possible to use a memory built into the memory 74 or system controller 72 as illustrated in FIG. 7, or a dedicated memory.

Moreover, desirably, the database is recorded on a detachable recording medium, in such a manner that a database updated in the inkjet recording apparatus 10 can be used in another apparatus. Instead of a detachable recording medium, it is also possible to adopt a composition in which the inkjet recording apparatus 10 is connectable to a network, in such a manner that the latest version of the database can be downloaded from the network.

Figure 15:
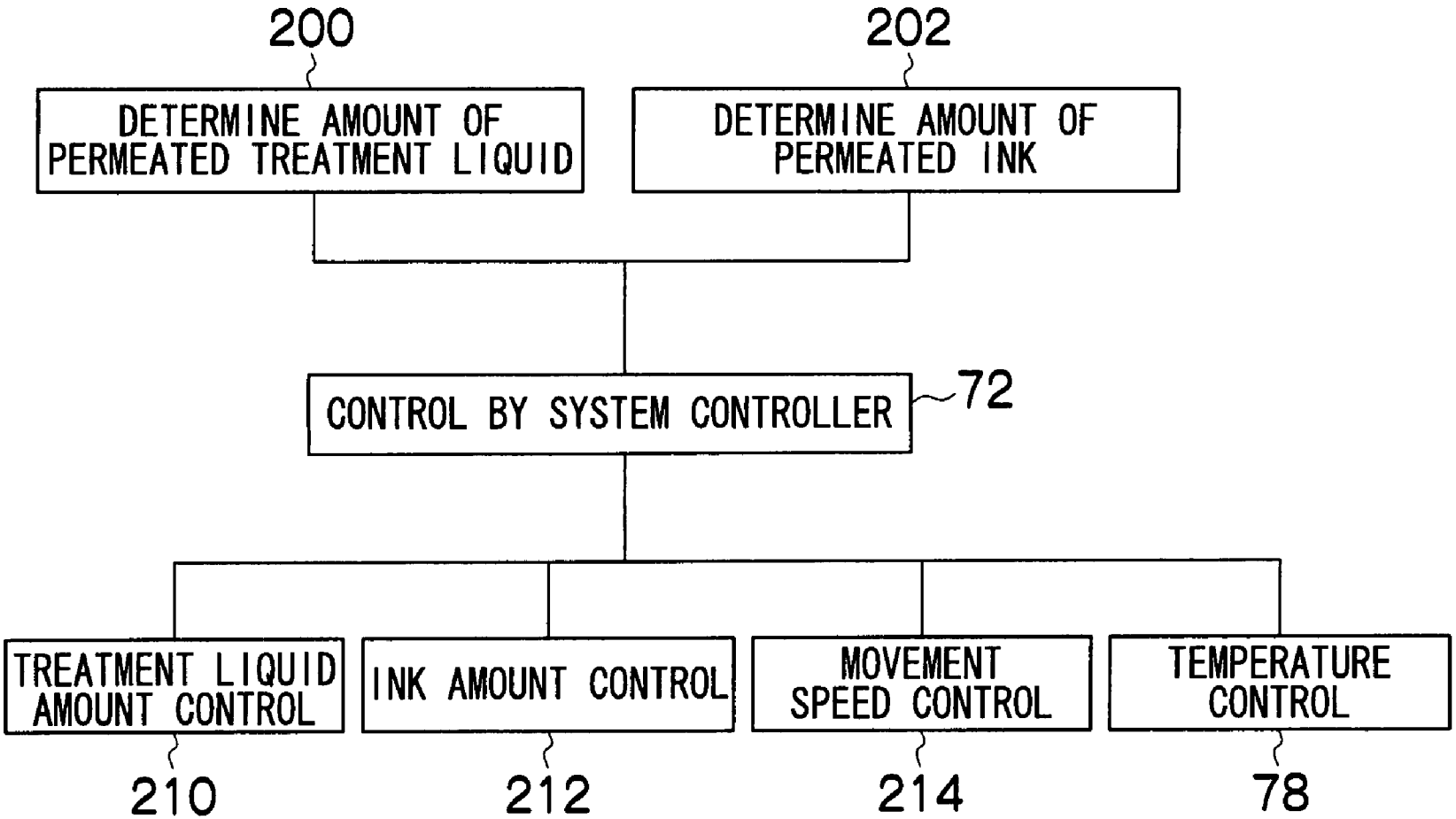
FIG. 15 is a block diagram showing one mode of a treatment liquid application control unit.

FIG. 15 shows a block diagram of a further mode of treatment liquid application control in the present inkjet recording apparatus 10.

As shown in FIG. 15, it is also possible to determine (calculate) the permeated amount of treatment liquid, rather than the permeation speed of the treatment liquid, in a treatment liquid permeation amount determination unit 200, on the basis of permeation speed information obtained from the permeation speed measurement unit 20 shown in FIG. 1. Furthermore, a composition may also be adopted in which the amount of permeated ink is determined by an ink permeation amount determination unit 202, on the basis of the difference in permeation characteristics between the treatment liquid and the ink. The relationship between the amount of permeated ink and the amount of permeated treatment liquid should be stored previously as a database, in the memory 74 shown in FIG. 7, or the like.

The system controller 72 sends control signals to a treatment liquid amount control unit 210 which controls the amount of treatment liquid applied to the paper, an ink amount control unit 212 which controls the amount of the ejected ink droplets, a movement speed control unit 214 which controls the belt suction conveyance unit 22 illustrated in FIG. 1, and the temperature control unit 78 shown in FIG. 7. The treatment liquid permeation amount determination unit 200, the ink permeation amount determination unit 202, and the movement speed control unit 214 may be formed as functional blocks of the system controller 72. Furthermore, the treatment liquid amount control unit 210 and the ink amount control unit 212 may be formed as functional blocks of the print controller 80 illustrated in FIG. 7.

Figure 16:
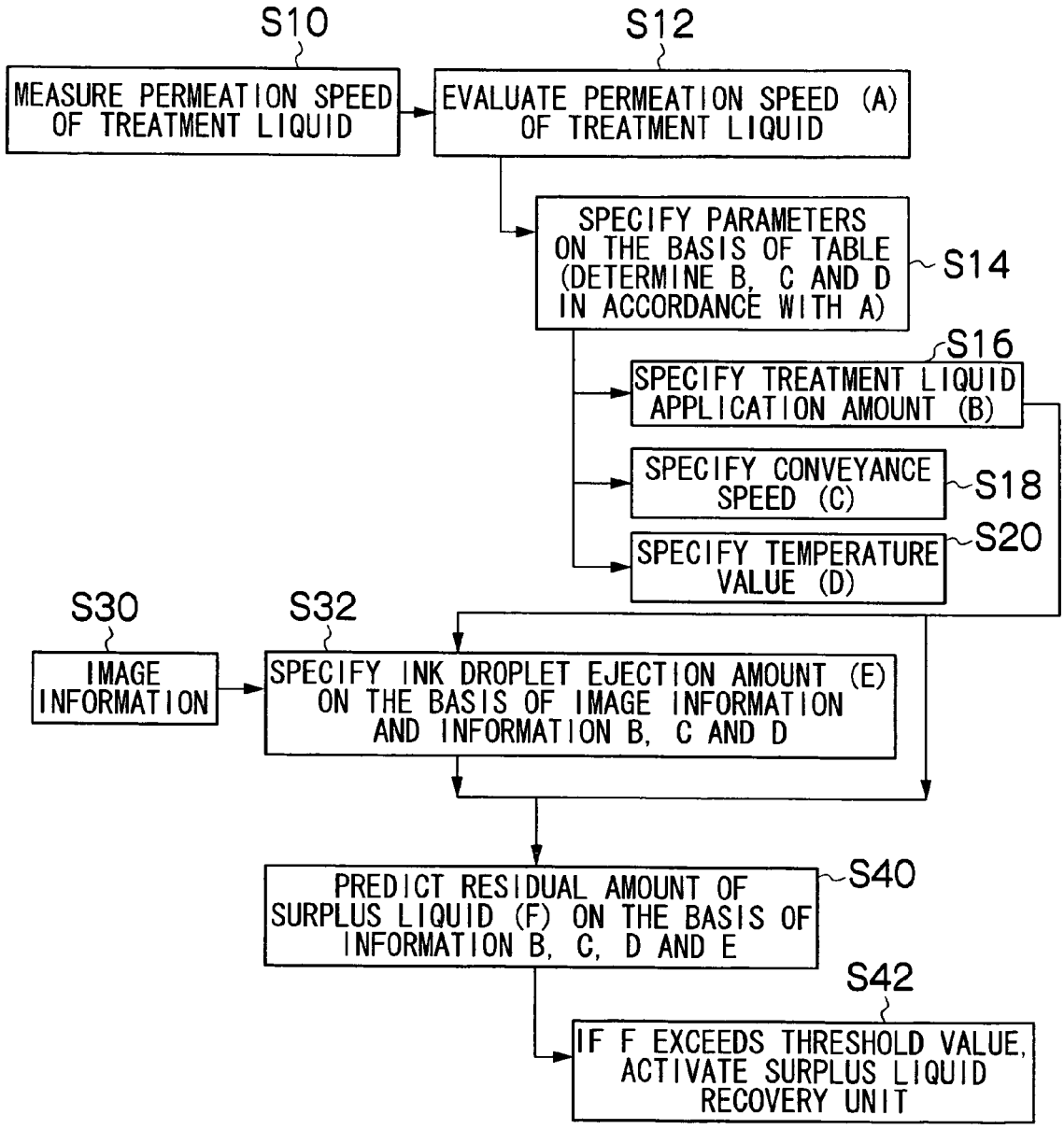
FIG. 16 is a flowchart showing the sequence of treatment liquid application control and ink droplet ejection control.

Next, the sequence of the treatment liquid application control and the ink droplet ejection control described above will be explained with reference to FIG. 16. When the permeation speed information has been obtained by the permeation speed measurement unit 20 shown in FIG. 1 (step S10), the treatment liquid permeation speed A (or the amount of permeated treatment liquid) is judged (step S12), and respective parameters are read out from a table which records the relationship between the treatment liquid permeation speed A, the treatment liquid application amount B, the conveyance speed C of the belt suction conveyance unit 22 shown in FIG. 1, and the temperature D of the recording paper 16 (step S14 in FIG. 16). The treatment liquid application amount B is specified (step S116), the conveyance speed C is specified (step S118), and the temperature D of the recording paper 16 is specified (step S20).

On the other hand, when the image information (image data) is obtained (step S30), the ink droplet ejection amount E is specified on the basis of the image information and the various information specified in steps S16, S18 and S20 (step S32).

Furthermore, the residual amount of surplus liquid F (namely, the total amount of the treatment liquid and the ink solvent remaining on the surface of the recording paper 16 without reacting) is predicted on the basis of the ink droplet ejection amount E specified at step S32, and the various information specified at step S16, S18 and S20 (step S40). If the remaining amount of surplus liquid F exceeds a prescribed threshold value, then control is implemented in such a manner that the surplus liquid recovery unit 42 shown in FIGS. 14A and 14B is operated.

In the inkjet recording apparatus 10 having the composition described above, the permeation speed of a treatment liquid applied to the recording paper 16 regardless of the image information is measured by a permeation speed measurement unit 20, and at least one factor, of the amount of treatment liquid applied, the temperature of the recording paper 16, and the conveyance speed of the recording paper 16, is controlled on the basis of the permeation speed judgment information obtained by the permeation speed measurement unit 20, in such a manner that a prescribed quantity of treatment liquid remains on the surface of the recording paper 16 until the time at which ink droplets are ejected onto the paper. Therefore, it is possible to apply treatment liquid and ink droplets of a quantity suited to the type of the recording paper 16, and consequently, stable printing quality is achieved, irrespective of the type of medium used. If the amount of treatment liquid applied is controlled, then image processing is carried out in such a manner that the amount of the ejected ink droplets is varied.

Since the permeation speed is measured by detecting a glossy reflection signal from the liquid, using a plurality of sensors provided in the determination region 41, it is possible to apply treatment liquid suitably both to media having rapid permeation and media having slow permeation, on the basis of the permeation speed judgment information.

Furthermore, the residual amount of surplus liquid remaining on the surface of the recording paper 16 after image formation is predicted, and if the residual amount of surplus liquid is greater than a previously established threshold value, the surplus liquid recovery unit 42 is operated and the surplus liquid on the surface of the recording paper 16 is recovered.

Therefore, it is possible to reduce the load on the post drying unit 44 which dries the recording paper 16 after image formation. The surplus liquid recovery unit 42 is particularly valuable when using non-permeable paper.

In the separation of the liquid functions in order to achieve insolubility and fixing properties in the dye, if the treatment liquid (first liquid) is set to a high viscosity, then the cationic base of the treatment liquid can be provided in greater quantity than in a low-viscosity liquid, and hence the functions can be achieved more reliably. Furthermore, if a permeable paper is used for the recording paper 16, then it is possible to eject ink droplets before the treatment liquid has permeated into the recording paper 16.

In the above-described embodiments, a print head used in an inkjet recording apparatus has been described as an example of a liquid droplet discharge head, but the present invention may also be applied to a discharge head used in a liquid discharge apparatus which forms three-dimensional images, or shapes, such as circuit wiring or machining patterns, by discharging a liquid (such as water, a chemical solution, resist, or processing liquid) onto a discharge receiving medium, such as a wafer, glass substrate, epoxy substrate, or the like.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus which forms images on a recording medium by combining at least two types of liquid, the apparatus comprising:

a first application device which applies a first liquid to the recording medium;

a second application device which applies a second liquid to the recording medium in accordance with an image to be formed on the recording medium;

a movement device which moves the first application device and the second application device relatively with respect to the recording medium;

a control device which performs at least one type of control, from among first liquid application amount change control which changes an applied amount of the first liquid, second liquid application amount change control which changes an applied amount of the second liquid, relative movement speed control of the recording medium by means of the movement device, and temperature variation control of the recording medium, in accordance with a permeation speed of at least one of the first liquid and the second liquid with respect to the recording medium; and a storage device which previously stores the permeation speed of at least one of the first liquid and the second liquid with respect to the recording medium, wherein the control device performs at least one type of control, from among the first liquid application amount change control which changes the applied amount of the first liquid, the second liquid application amount change control which changes the applied amount of the second liquid, the relative movement speed control of the recording medium by means of the movement device, and the temperature variation control of the recording medium, in accordance with information on the permeation speed of the at least one of the first liquid and the second liquid stored in the storage device, wherein the control device performs application amount change control which changes the applied amount of at least one of the first liquid and the second liquid, in accordance with the permeation speed of one of the first liquid and the second liquid that has been applied to the recording medium before the other of the first liquid and the second liquid.

2. The inkjet recording apparatus as defined in claim 1, wherein:

the first liquid includes a transparent treatment liquid which is applied to the recording medium regardless of image data of the image to be formed on the recording medium;

the second liquid includes ink which is applied to the recording medium in accordance with the image data; and the inkjet recording apparatus further comprises an image processing device for processing the image data in accordance with at least one of the permeation speed of the first liquid and the applied amount of the first liquid.

3. The inkjet recording apparatus as defined claim 1, further comprising a liquid recovery device which recovers at least one of the first liquid and the second liquid remaining on the recording medium after the image has been formed on the recording medium.

4. The inkjet recording apparatus as defined in claim 3, further comprising:

a residual liquid amount prediction device which predicts an remaining amount of at least one of the first liquid and the second liquid after an image has been formed on the recording medium, wherein the liquid recovery device recovers the at least one of the first liquid and the second liquid remaining on the recording medium according to a result of prediction obtained by the residual liquid amount prediction device.

5. The inkjet recording apparatus as defined in claim 4, further comprising:

a storage device for storing information such as type of recording medium, temperature, and/or elapsed time from application of the first liquid or the second liquid on the recording medium;

wherein the information stored in said storage device is used by said residual liquid amount prediction device to recover at least one of the first liquid and the second liquid remaining on the recording medium.

6. The inkjet recording apparatus as defined in claim 1, wherein the first application device includes a flexible porous member which applies the first liquid to the recording medium while making contact with the recording medium.

7. The inkjet recording apparatus as defined in claim 1, wherein the first liquid has higher viscosity than the second liquid.

8. The inkjet recording apparatus as defined in claim 1, wherein the second application device includes a discharge head which discharges the second liquid onto the recording medium.

9. The inkjet recording apparatus as defined in claim 1, wherein:

the first liquid includes a transparent liquid containing a cationic polymer; and the second liquid includes a colored ink containing an anionic polymer.

10. A inkjet recording apparatus which forms images on a recording medium by combining at least two types of liquid, the apparatus comprising:

a first application device which applies a first liquid to the recording medium;

a second application device which applies a second liquid to the recording medium in accordance with an image to be formed on the recording medium;

a movement device which moves the first application device and the second application device relatively with respect to the recording medium;

a control device which performs at least one type of control, from among first liquid application amount change control which changes an applied amount of the first liquid, second liquid application amount change control which changes an applied amount of the second liquid, relative movement speed control of the recording medium by means of the movement device, and temperature variation control of the recording medium, in accordance with a permeation speed of at least one of the first liquid and the second liquid with respect to the recording medium; and a measurement device which measures the permeation speed of at least one of the first liquid and the second liquid with respect to the recording medium, wherein the control device performs at least one type of control, from among the first liquid application amount change control which changes the applied amount of the first liquid, the second liquid application amount change control which changes the applied amount of the second liquid, the relative movement speed control of the recording medium by means of the movement device, and the temperature variation control of the recording medium, in accordance with the permeation speed of the at least one of the first liquid and the second liquid with respect to the recording medium measured by the measuring device, and wherein the measurement device comprises a glossy reflection intensity measurement device which measures glossy reflection intensity of a droplet of the liquid on a surface of the recording medium, and wherein the control device performs application amount change control which changes the applied amount of at least one of the first liquid and the second liquid, in accordance with the permeation speed of one of the first liquid and the second liquid that has been applied to the recording medium before the other of the first liquid and the second liquid.

11. The inkjet recording apparatus as defined in claim 10, wherein:

the first liquid includes a transparent treatment liquid which is applied to the recording medium regardless of image data of the image to be formed on the recording medium;

the second liquid includes ink which is applied to the recording medium in accordance with the image data; and the inkjet recording apparatus further comprises an image processing device for processing the image data in accordance with at least one of the permeation speed of the first liquid and the applied amount of the first liquid.

12. The inkjet recording apparatus as defined claim 10, further comprising a liquid recovery device which recovers at least one of the first liquid and the second liquid remaining on the recording medium after the image has been formed on the recording medium.

13. The inkjet recording apparatus as defined in claim 12, further comprising:

a residual liquid amount prediction device which predicts an remaining amount of at least one of the first liquid and the second liquid after an image has been formed on the recording medium, wherein the liquid recovery device recovers the at least one of the first liquid and the second liquid remaining on the recording medium according to a result of prediction obtained by the residual liquid amount prediction device.

14. The inkjet recording apparatus as defined in claim 10, wherein the first application device includes a flexible porous member which applies the first liquid to the recording medium while making contact with the recording medium.

15. The inkjet recording apparatus as defined in claim 10, wherein the first liquid has higher viscosity than the second liquid.

16. The inkjet recording apparatus as defined in claim 10, wherein the second application device includes a discharge head which discharges the second liquid onto the recording medium.

17. The inkjet recording apparatus as defined in claim 10, wherein:

the first liquid includes a transparent liquid containing a cationic polymer; and the second liquid includes a colored ink containing an anionic polymer.

18. A liquid application method for an inkjet recording apparatus which forms images on a recording medium by combining at least two types of liquid, the method comprising:

a first application step of applying a first liquid to the recording medium by a first application device;

a second application step of applying a second liquid to the recording medium by a second application device in accordance with an image to be formed on the recording medium;

a movement step of moving the first application device and the second application device relatively with respect to the recording medium by a movement device;

a measurement step of measuring a permeation speed of at least one of the first liquid and the second liquid with respect to the recording medium by a measurement device, and measuring a glossy reflection intensity of a droplet of the liquid on a surface of the recording medium by a glossy reflection intensity measurement device;

a control step of performing at least one type of control, from among first liquid application amount change control which changes an applied amount of the first liquid, second liquid application amount change control which changes an applied amount of the second liquid, relative movement speed control of the recording medium by means of the movement device, and temperature variation control of the recording medium, in accordance with the permeation speed of at least one of the first liquid and the second liquid with respect to the recording medium measured in the measurement step; and a second control step of performing application amount change control which changes the applied amount of at least one of the first liquid and the second liquid, in accordance with the permeation speed of one of the first liquid and the second liquid that has been applied to the recording medium before the other of the first liquid and the second liquid.

19. A inkjet recording apparatus which forms images on a recording medium by combining at least two types of liquid comprising:

a first application device which applies a first liquid type to the recording medium;

a second application device which applies a second liquid type to the recording medium;

a movement device which provides relative movement between the recording medium, the first application device and the second application device;

a control device which according to a permeation speed controls at least one of the following devices: the first application device which changes the amount of the first liquid type applied to the recording medium, the second application device which changes the amount of the second liquid type applied to the recording medium, the movement device which changes the relative movement speed of the recording medium, and a temperature variation device which varies the temperature of the recording medium; and a storage device which previously stores the permeation speed, wherein the permeation speed is defined as the speed at which at least one of the first liquid type and second liquid type permeates the recording medium, and wherein the control device according to the information of the permeation speed stored in the storage device controls at least one of the following devices: the first application device which changes the amount of the first liquid applied to the recording medium, the second application device which changes the amount of the second liquid applied to the recording medium, the movement device which changes the relative movement speed of the recording medium, and a temperature variation device which varies the temperature of the recording medium, wherein the control device performs application amount change control which changes the applied amount of at least one of the first liquid and the second liquid, in accordance with the permeation speed of one of the first liquid and the second liquid that has been applied to the recording medium before the other of the first liquid and the second liquid.

20. The inkjet recording apparatus as defined in claim 19, wherein:

the first liquid type is applied to a first area of the recording medium; and the second liquid type is applied to the first area of the recording medium in accordance with the image data.

21. The inkjet recording apparatus as defined in claim 19, wherein:

the first liquid type includes a treatment liquid; and the second liquid type includes ink.

22. The inkjet recording apparatus as defined in claim 19, wherein:

the first liquid type includes a liquid containing a cationic polymer; and the second liquid type includes an ink containing an anionic polymer.

23. A liquid application method for an inkjet recording apparatus which forms images on a recording medium by combining at least two types of liquid, the method comprising:

a first application step of applying a first liquid to the recording medium by a first application device;

a second application step of applying a second liquid to the recording medium by a second application device in accordance with an image to be formed on the recording medium;

a movement step of moving the first application device and the second application device relatively with respect to the recording medium by a movement device;

a storing step of previously storing a permeation speed of at least one of the first liquid and the second liquid with respect to the recording medium in a storage device;

a control step of performing at least one type of control, from among first liquid application amount change control which changes an applied amount of the first liquid, second liquid application amount change control which changes an applied amount of the second liquid, relative movement speed control of the recording medium by means of the movement device, and temperature variation control of the recording medium, in accordance with information on the permeation speed of at least one of the first liquid and the second liquid with respect to the recording medium stored in the storing step; and a second control step of performing application amount change control which changes the applied amount of at least one of the first liquid and the second liquid, in accordance with the permeation speed of one of the first liquid and the second liquid that has been applied to the recording medium before the other of the first liquid and the second liquid.

* * * * *